US010955112B2

(12) United States Patent
Portinga

(10) Patent No.: US 10,955,112 B2
(45) Date of Patent: Mar. 23, 2021

(54) ADJUSTABLE OPTIC AND LIGHTING DEVICE ASSEMBLY

(71) Applicant: Troy-CSL Lighting Inc., City of Industry, CA (US)

(72) Inventor: Joshua Portinga, City of Industry, CA (US)

(73) Assignee: Troy-CSL Lighting, Inc., City of Industry, CA (US)

( * ) Notice: Subject to any disclaimer, the term of this patent is extended or adjusted under 35 U.S.C. 154(b) by 18 days.

(21) Appl. No.: 16/175,470

(22) Filed: Oct. 30, 2018

(65) Prior Publication Data

US 2020/0132278 A1 Apr. 30, 2020

(51) Int. Cl.
*F21V 7/04* (2006.01)
*F21V 15/01* (2006.01)
(Continued)

(52) U.S. Cl.
CPC ..... *F21V 7/04* (2013.01); *F21V 15/01* (2013.01); *F21V 23/001* (2013.01); *F21V 29/70* (2015.01);
(Continued)

(58) Field of Classification Search
CPC ..... F21V 21/30; F21V 14/04; F21V 14/045; F21V 14/06; F21V 14/065; F21V 29/83;
(Continued)

(56) References Cited

U.S. PATENT DOCUMENTS 3,124,309 A 3/1964 Cantoni et al.
5,274,535 A 12/1993 Gonser
(Continued)

FOREIGN PATENT DOCUMENTS

CN 201637870 U 11/2010
CN 201779470 U 3/2011
(Continued)

OTHER PUBLICATIONS

Ito, Lighting System and Fresnel Lens, Sep. 29, 2011, JP2011192494A, English (Year: 2011).*
(Continued)

*Primary Examiner* — Bryon T Gyllstrom
*Assistant Examiner* — James M Endo
(74) *Attorney, Agent, or Firm* — Foley & Lardner LLP

(57) ABSTRACT

A lighting device includes: a light source; an optic device to pass at least some light from the light source; an optic assembly including a holding member having an interior volume to contain the optic device; and a housing member having a first curved surface defining a cavity to receive at least a portion of the holding member. The holding member has an outer surface having a curvature that slideably engages with the first curved surface of the housing member when the optic assembly is pivoted about the light source. The optic device includes a recessed bottom surface facing the light source, one or more reflective elements arranged on the recessed bottom surface to refract light received from the light source at a critical angle, and an emitting surface opposite the recessed bottom surface to internally reflect the light refracted by the one or more reflective elements to be absorbed.

25 Claims, 14 Drawing Sheets

(51) Int. Cl.

| | |
|---|---|
| ***F21V 23/00*** | (2015.01) |
| ***F21V 29/70*** | (2015.01) |
| ***F21V 21/30*** | (2006.01) |
| ***F21V 14/04*** | (2006.01) |
| ***F21V 14/06*** | (2006.01) |
| ***F21V 13/04*** | (2006.01) |

(52) U.S. Cl.
CPC ..... *F21V 13/04* (2013.01); *F21V 14/04* (2013.01); *F21V 14/06* (2013.01); *F21V 21/30* (2013.01)

(58) Field of Classification Search
CPC .... F21V 29/503; F21V 29/70; F21V 19/0025; F21V 23/001; F21V 5/045; F21V 19/003; F21V 19/04; F21V 19/0045; F21V 23/002; F21V 23/006; F21V 17/002; F21V 14/02; F21Y 2113/20; F21S 10/023
USPC ..... 362/427, 227, 280, 281, 282, 283, 287, 362/285
See application file for complete search history.

(56) References Cited

U.S. PATENT DOCUMENTS

| | | | | |
|---|---|---|---|---|
| 5,404,297 | A * | 4/1995 | Birk | B64D 11/00 362/421 |
| 5,833,346 | A | 11/1998 | Denley | |
| 8,398,271 | B2 | 3/2013 | Chan | |
| 9,255,676 | B2 | 2/2016 | Hoog | |
| 9,618,163 | B2 | 4/2017 | Power et al. | |
| 9,664,353 | B2 | 5/2017 | Maliar et al. | |
| 9,982,855 | B1 | 5/2018 | Tan | |
| 10,145,519 | B1 | 12/2018 | Portinga | |
| 10,378,733 | B1 | 8/2019 | McLellan | |
| 2004/0124487 | A1* | 7/2004 | Loh | F21K 9/00 257/433 |
| 2008/0036397 | A1* | 2/2008 | Hockel | F21V 23/06 315/294 |
| 2008/0074883 | A1* | 3/2008 | Li | F21V 29/74 362/294 |
| 2008/0158894 | A1 | 7/2008 | Dixon et al. | |
| 2009/0290351 | A1* | 11/2009 | Chan | F21V 14/04 362/277 |
| 2011/0164422 | A1* | 7/2011 | Chan | F21V 14/04 362/284 |
| 2011/0267834 | A1 | 11/2011 | Potucek et al. | |
| 2012/0156920 | A1* | 6/2012 | Sakai | H01R 4/4818 439/387 |
| 2012/0162985 | A1 | 6/2012 | Kauffman et al. | |
| 2012/0182723 | A1 | 7/2012 | Sharrah et al. | |
| 2012/0243229 | A1 | 9/2012 | Cheng et al. | |
| 2013/0076269 | A1 | 3/2013 | Shilton | |
| 2013/0107549 | A1* | 5/2013 | Yeh | H05K 3/0061 362/382 |
| 2014/0313727 | A1 | 10/2014 | Dupre et al. | |
| 2014/0313737 | A1 | 10/2014 | Watson | |
| 2014/0355273 | A1* | 12/2014 | Saito | F21V 5/04 362/309 |
| 2015/0092417 | A1* | 4/2015 | Hoog | F21S 8/026 362/277 |
| 2015/0117040 | A1 | 4/2015 | Hartmann et al. | |
| 2015/0300612 | A1 | 10/2015 | Stathes et al. | |
| 2015/0369430 | A1* | 12/2015 | Vamberi | F21V 14/00 362/235 |
| 2016/0025319 | A1* | 1/2016 | Meyer | F21V 23/006 362/382 |
| 2016/0363747 | A1* | 12/2016 | Krijn | G02B 19/0066 |
| 2017/0074488 | A1 | 3/2017 | Fujisawa et al. | |
| 2017/0114984 | A1* | 4/2017 | Dross | G02B 19/0028 |
| 2017/0122534 | A1 | 5/2017 | Ticktin et al. | |
| 2017/0307196 | A1 | 10/2017 | Matsui | |
| 2019/0063736 | A1 | 2/2019 | Zeng et al. | |
| 2020/0200377 | A1 | 6/2020 | Portinga et al. | |

FOREIGN PATENT DOCUMENTS

| | | | | |
|---|---|---|---|---|
| CN | 201779520 | U | 3/2011 | |
| CN | 201982999 | U | 9/2011 | |
| CN | 201983139 | U | 9/2011 | |
| CN | 202125815 | U | 1/2012 | |
| CN | 202132746 | U | 2/2012 | |
| CN | 202274433 | U | 6/2012 | |
| CN | 103162149 | A | 6/2013 | |
| JP | S63-185746 | U | 11/1988 | |
| JP | 4400886 | B2 | 1/2010 | |
| JP | 2011192494 | A * | 9/2011 | |
| JP | 2012-069370 | A | 4/2012 | |
| JP | 6164928 | B2 | 7/2017 | |
| WO | WO-0102775 | A1 * | 1/2001 | F21V 17/02 |
| WO | WO-2013/014888 | A1 | 1/2013 | |

OTHER PUBLICATIONS

Non-Final Office Action dated Dec. 2, 2019, from U.S. Appl. No. 16/226,526.
Non-Final Office Action dated Sep. 9, 2019, from U.S. Appl. No. 15/828,243.
Hung, et al., "Digital LED Desk Lamp with Automatic Uniform Illumination Area by Using Two Accelerometers and Halftone Method" IEEE ISCE 2014 1569933999.
Minebea, "A revolutionary lighting able to completely control light, created by combining the application of optical technology with precision components", 2017, http://www.minebeamitsumi.com/english/strengths/column/saliot/index.html.
Minebea, "Minebea to Start Mass Production and Sales of New LED Lighting (Smart Adjustable Light for IoT (SALIOT))", Jul. 15, 2015 Press Release, http://www.minebeamitsumi.com/english/news/press/2015/1189602_7564.html.
U.S. Non-Final Office Action dated Jul. 5, 2018, from U.S. Appl. No. 15/984,008.
Notice of Allowance dated Oct. 2, 2018, from U.S. Appl. No. 15/984,008.
Final Office Action dated Mar. 24, 2020, from U.S. Appl. No. 15/828,243.
Notice of Allowance dated Mar. 26, 2020, from U.S. Appl. No. 16/226,526.
Notice of Allowance dated Jul. 30, 2020, from U.S. Appl. No. 15/828,243.
Extended European Search Report dated Apr. 23, 2020, from application No. 19217434.0.
Non-Final Office Action dated Sep. 4, 2020, from U.S. Appl. No. 16/897,598.
Notice of Allowance dated Jan. 13, 2021, from U.S. Appl. No. 16/808,102.
Notice of Allowance dated Jan. 13, 2021, from U.S. Appl. No. 16/897,598.

* cited by examiner

ADJUSTABLE OPTIC AND LIGHTING DEVICE ASSEMBLY

BACKGROUND

Lighting devices such as, but not limited to, track lights, can include configurations that allow for adjustment of the direction of emitted light or light beam. Such lighting devices may include a light source, such as a light emitting diode (LED). Typically, the brightness of an LED light source is directly related to the speed in which heat can be transferred away from the LED component, which should desirably be maintained under about 105° Celsius. However, if the LED component is mounted on a moveable structure, such as a free floating fixture head that is movable to adjust a light beam direction, heat may not be efficiently transferred from the LED component through the moveable structure. Therefore, the brightness of light emitted from the LED light source may be reduced.

If the lighting device has a light source that is mounted directly to a fixture housing of substantial mass and suitable heat conductive material, the fixture housing may help to dissipate heat away from the LED light source, to improve LED performance. However, in lighting devices having light sources fixed to fixture housings of sufficient mass for heat dissipation, it may not be possible to adjust the direction of a downlight beam. In addition, if the lighting device includes a fixture head that is moveable together with the optics to adjust the direction of emitted light, some light may be blocked by the bezel or housing containing the optics and light source, when the fixture head is moved.

SUMMARY

One or more examples and aspects described herein relate to an optic assembly having an adjustable optic to shape a light field of light emitted through the adjustable optic. Other examples and aspects described herein relate to a lighting device and a lighting device assembly including that optic assembly. One or more examples and aspects described herein relate to an optic assembly having an adjustable optic, a lighting device or a lighting device assembly that includes that optic and has improved heat transfer characteristics.

According to an example embodiment, a lighting device assembly includes: a light source; an optic device configured to pass at least some light from the light source; an optic assembly configured to pivot about the light source, the optic assembly including a holding member having an interior volume in which the optic device is contained; and a housing member having a first curved surface defining a cavity in which at least a portion of the holding member is received. The holding member has an outer surface having a curvature that is configured to slideably engage with the first curved surface of the housing member when the optic assembly is pivoted about the light source. The optic device includes: a recessed bottom surface facing the light source; one or more reflective elements arranged on the recessed bottom surface and configured to refract light received from the light source at a critical angle; and an emitting surface opposite the recessed bottom surface, the emitting surface configured to internally reflect the light refracted by the one or more reflective elements. The lighting device is configured to absorb the light that is internally reflected by the emitting surface.

In an example embodiment, the critical angle may be 39 degrees or greater with respect to a normal of the emitting surface.

In an example embodiment, the one or more reflective elements may include a material having a refractive index of 1.4 to 1.6.

In an example embodiment, each of the one or more reflective elements may have an inner annular side surface that is substantially perpendicular to a focal axis of the optic device, and an outer annular side surface that is angled relative to the focal axis of the optic and sloped downward towards the emitting surface and outward towards a periphery of the optic device.

In an example embodiment, the device may further include a heat sink having a first end connected to the light source and facing the recessed bottom surface, a second end opposite the first end, and a side surface between the first end and the second end.

In an example embodiment, a plurality of channels may be formed on the side surface, each of the plurality of channels having an opening along its entire length at the side surface.

In an example embodiment, each of the plurality of channels may have a cross-sectional shape of a portion of a circle with an arc cutout for the opening, a width of the arc cutout being smaller than a diameter of the circle.

In an example embodiment, the device may further include a frame member attached to the first end of the heat sink with the light source interposed between the first end and the frame member, the frame member configured to electrically connect the light source to a plurality of wires received in at least some of the plurality of channels.

In an example embodiment, the frame member may include: wire contacts connected to the plurality of wires; and terminal pads configured to align with and contact terminals of the light source when the frame member is attached to the first end of the heat sink with the light source interposed between the first end and the frame member.

In an example embodiment, the first end of the heat sink may include a receiving groove configured to hold the light source.

According to an example embodiment, a lighting device includes: a heat sink having a first end, a second end opposite the first end, and a side surface between the first end and the second end; a light source contacting the first end of the heat sink; a frame member attached to the first end of the heat sink with the light source interposed between the first end and the frame member, the frame member configured to electrically connect the light source to a plurality of wires; an optic device configured to pass at least some light from the light source; an optic assembly configured to pivot about the light source, the optic assembly including a holding member having an interior volume in which the optic device is contained; and a housing member having a first curved surface defining a cavity in which at least a portion of the holding member is received. The holding member has an outer surface having a curvature that is configured to slideably engage with the first curved surface of the housing member when the optic assembly is pivoted about the light source.

In an example embodiment, a plurality of channels may be formed on the side surface of the heat sink, each of the plurality of channels having an opening along its entire length at the side surface.

In an example embodiment, each of the plurality of channels may have a cross-sectional shape of a portion of a circle with an arc cutout for the opening, a width of the arc cutout being smaller than a diameter of the circle.

In an example embodiment, each of the plurality of wires may be configured to be inserted in a corresponding one of the plurality of channels from the side surface of the heat sink via the opening.

In an example embodiment, some of the plurality of channels may not receive any of the plurality of wires.

In an example embodiment, the frame member may include: wire contacts connected to the plurality of wires; and terminal pads aligned with terminals of the light source when the frame member is attached to the first end of the heat sink with the light source interposed between the first end and the frame member.

In an example embodiment, the light source may not be attached to the frame member, and the frame member may press against the light source so that the terminal pads of the frame member contact the terminals of the light source when the frame member is attached to the first end of the heat sink.

In an example embodiment, the frame member may be a double-sided aluminum core circuit board.

In an example embodiment, the first end of the heat sink may include a receiving groove configured to hold the light source.

In an example embodiment, the receiving groove may have a shape configured to receive various different kinds of light sources having different shapes and/or dimensions.

BRIEF DESCRIPTION OF THE DRAWINGS

The above and other aspects and features of the present invention will become more apparent to those skilled in the art from the following detailed description of the example embodiments with reference to the accompanying drawings, in which.

DETAILED DESCRIPTION

Figure 1A:
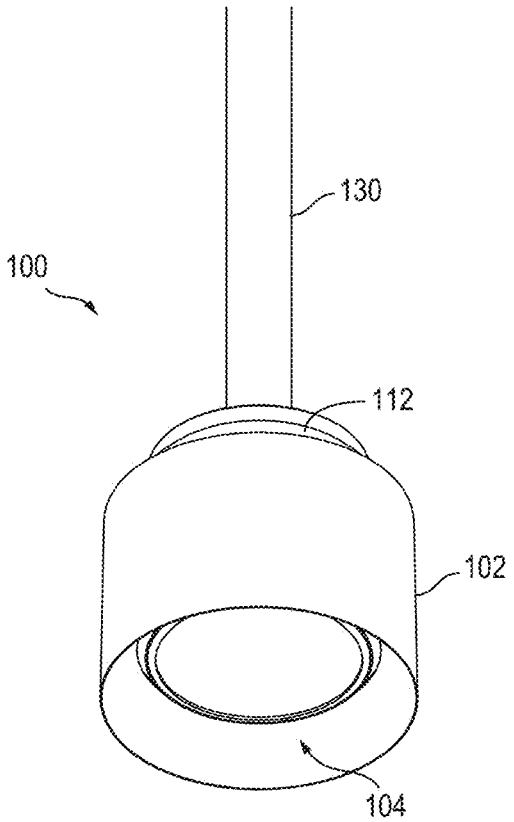
FIGS. 1A and 1B are perspective views of a lighting device assembly according to various example embodiments.

Hereinafter, example embodiments will be described in more detail with reference to the accompanying drawings. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated. Further, features or aspects within each example embodiment should typically be considered as available for other similar features or aspects in other example embodiments.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

According to various embodiments, a light source of a lighting device assembly may be attached to one end of a heat sink, and another end of the heat sink may be closely related to (integral or in contact with) a surface of an object (e.g., a fixture housing or other object of sufficient heat conveying mass) to which the lighting device assembly is mounted. Accordingly, heat transferred from the light source may be improved.

According to various embodiments, the light source of the lighting device assembly may be extended within a recess of an optic, and the optic may move (e.g., pivot and/or rotate) freely about the light source while the light source remains within the recess of the optic and in a fixed relation with the optic. Accordingly, light emitted from the light source may be beam-shifted to a portion of the optic that is pivoted outward, and thus, light loss may be reduced.

Figure 1B:
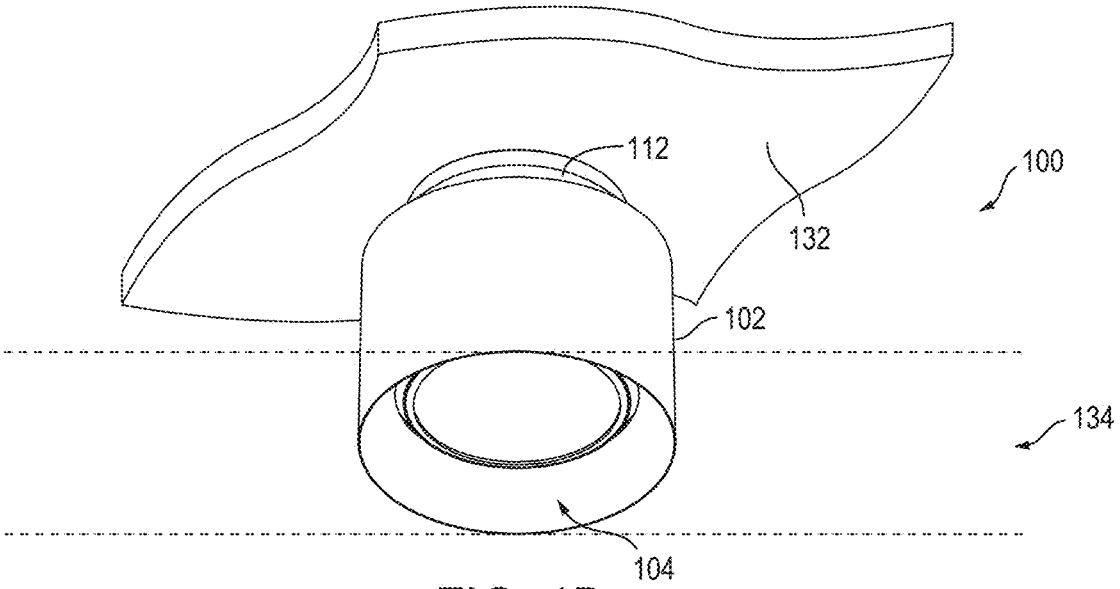

FIGS. 1A and 1B are perspective views of two examples of a lighting device assembly according to various embodiments of the present invention, where like elements in those drawings are labeled with like reference numbers. Referring to FIGS. 1A and 1B, the lighting device assembly 100 may include a housing member (or a bezel) 102, an optic assembly 104, and a top member (e.g., a mounting bracket) 112. The optic assembly 104 may pivot and/or rotate within the housing member 102 to adjust a direction of emitted light. While FIGS. 1A and 1B show that the housing member 102 generally has a cylindrical shape, other embodiments may include housing members 102 having other suitable shapes, including but not limited to curved or partially spherical shapes, conical, cube or cuboid shapes, rectangular shapes, triangular shapes, or the like.

In various embodiments, the lighting device assembly 100 may be mounted to various structures and/or incorporated into various structures. For example, as shown in FIG. 1A, the lighting device assembly 100 may be attached to an end of an extension member (e.g., a rod or pole) 130, as in the case of a pendent light, desk light, lamp, and the like. In some other examples, as shown in FIG. 1B, the lighting device assembly 100 may be mounted to a surface of an object (such as, but not limited to, a fixture housing, track lighting, downlights, linear lights, board, ceiling, wall, floor, and the like) 132, or may be recessed into a surface of an object (such as, but not limited to a ceiling, wall, floor, shelf, cabinet, and the like) 134. Further, in various embodiments, a plurality of lighting device assemblies 100 may be arranged in various combinations as desired. While FIGS. 1A and 1B show two examples of lighting device shapes and relative dimensions, other embodiments have other suitable shapes and relative dimensions.

Figure 2:
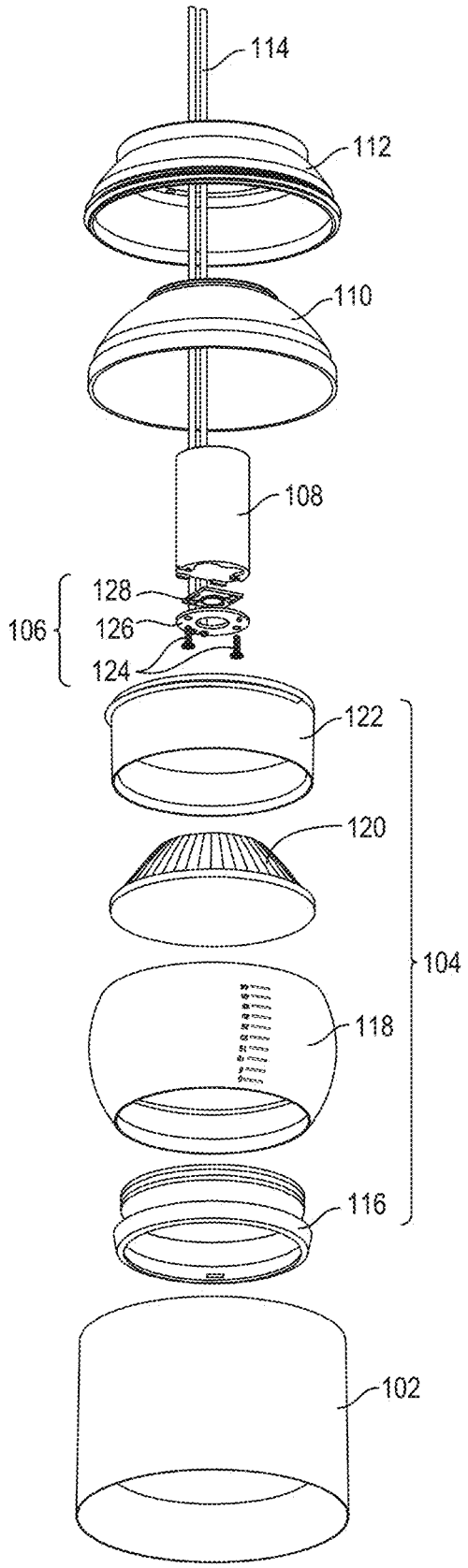
FIG. 2 is an exploded view of a lighting device assembly according to an example embodiment.
Figure 3:
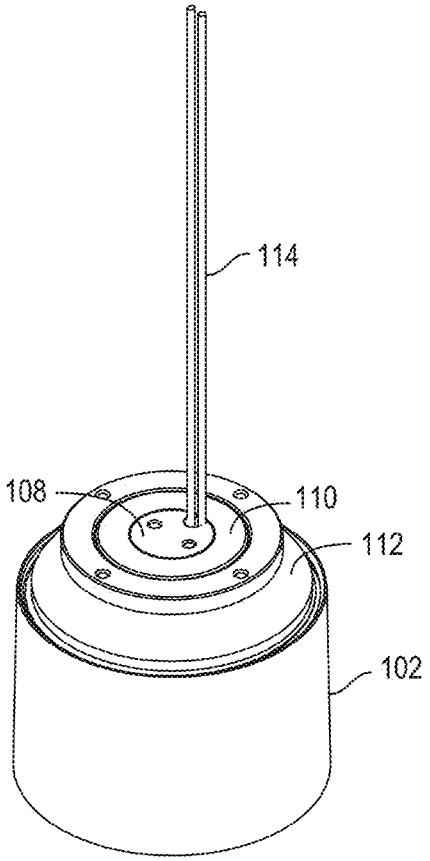
FIG. 3 is a perspective top view of a lighting device assembly according to an example embodiment.

FIG. 2 is an exploded view of a lighting device assembly according to an embodiment of the present invention, and FIG. 3 is a perspective top view of a lighting device assembly according to an embodiment of the present invention. Referring to FIG. 2, the lighting device assembly 100 may include the housing member 102, an optic assembly 104, a light source assembly 106, a heat sink 108, a friction member 110, and the top member 112. In various embodiments, one or more wires 114 for electrically connecting a light source of the light source assembly 106 to a power source may extend through the top member 112 (e.g., via the heat sink 108 as shown in FIG. 3), but the present invention is not limited thereto. For example, in a case where the light source is powered by a battery, the wires 114 may not extend through the top member 112 or may be omitted. In other embodiments, the wires 114 may extend from a side of the top member 112, or the like.

In various embodiments, the optic assembly 104 may include a lens filter 116, a holding member 118, an optic 120 (one or more lens, filter or combination thereof), and a locking member (e.g., a locking ring) 122. The lens filter 116 may change a characteristic of emitted light (e.g., color, brightness, focus, polarization, linear spread filter, wall wash filter, baffles, glare guards, snoots, and/or the like). However, the present invention is not limited thereto, and the lens filter 116 may be optional or omitted.

The holding member 118 receives the optic 120, and may facilitate the movement (e.g., pivot and/or rotation) of the optic 120 within the housing member 102. For example, the holding member 118 may slideably engage a cavity of the housing member 102 in a ball and socket manner. In various embodiments, the holding member 118 may have an outer surface having a curvature that is held within a corresponding cavity (with a corresponding mating curvature and dimension) within the housing member 102. For example, the outer surface of the holding member 118 may have a shape of a portion of a sphere, and may be held within a corresponding sphere-shaped cavity within the housing member 102. Accordingly, the optic 120 may pivot in any direction (e.g., on a 360 degree plane) within the housing member 102, by slideably engaging the cavity of the housing member 102. However, the present invention is not limited thereto, and in another embodiment, the pivoting directions of the optic 120 may be limited or reduced, for example, by providing stop surfaces or a shape of the surface of the holding member 118 and/or a shape of the cavity within the housing member 102, that limits movement in one or more directions.

The optic 120 may include a recess R or opening (discussed below with reference to FIG. 4) on a surface facing the light source assembly 106. The recess R may receive at least a portion of the light source assembly 106 and heat sink 108. In various embodiments, the light source assembly 106 and heat sink 108 may extend at least partially into the recess R, and may remain at least partially within the recess R throughout the full range of adjustable movement (e.g., pivot and/or rotation) of the optic 120 (described in more detail below with reference to FIGS. 4-6).

The locking member 122 may lock the optic 120 to the holding member 118. For example, the locking member 122 may have a tubular (or ring) shape, and may lock (e.g., twist-lock) the optic 120 at a position within the holding member 118. The light source assembly 106 and heat sink 108 may extend through the locking member 122 into the recess of the optic 120. However, the present invention is not limited thereto, and in other embodiments, the locking member 122 may be omitted. For example, in other embodiments, the optic 120 may have a self-locking (e.g., twist-lock) mechanism to be locked within the holding member 118, and in this case, the locking member 122 may be omitted.

In various embodiments, the light source assembly 106 may include a light source 128. The light source 128 may include, for example, one or more light emitting diodes (LEDs), or an array of multiple LEDs. However, the present invention is not limited thereto, and in other embodiments, the light source 128 may include any suitable light source (e.g., LED, incandescent, halogen, fluorescent, combinations thereof, and/or the like). In some embodiments, the light source 128 may emit white light. In other embodiments, the light source 128 may emit any suitable color or frequency of light, or may emit a variety of colored lights. For example, when the light source includes an array of LEDs, each of the LEDs (or each group of plural groups of LEDs in the array) may emit a different colored light (such as, but not limited to white, red, green, and blue), and, in further embodiments, two or more of the different colored lights may be selectively operated simultaneously to mix and produce a variety of different colored lights, or in series to produce light that changes in color over time.

In various embodiments, the light source assembly 106 may further include an attachment element 124 and a frame member 126. The light source 128 may be attached (or mounted) to the heat sink 108 via the attachment element 124 and the frame member 126. For example, the frame member 126 may be arranged over the light source 128, and connected to the heat sink 108 via the attachment element 124 with the light source 128 interposed therebetween. The attachment element 124 may include one or more of any suitable attachment elements, for example, a screw, a nail, a clip, an adhesive, and/or the like. However, the present invention is not limited thereto, and in other embodiments, the frame member 126 may be omitted, and the light source 128 may be directly attached (or mounted) to the heat sink 108.

In various embodiments, the heat sink 108 may draw heat away from the light source 128. Accordingly, the heat sink 108 may be made of any suitable material, composition, or layers thereof having sufficient heat transfer and/or dissipation qualities, for example, aluminum, copper, and/or the like. In an example embodiment, the heat sink 108 may be formed (e.g., cast) from solid aluminum. The heat sink 108 may have a shape corresponding to an elongated body (e.g., a pedestal) that extends from the top member 112 to the recess of the optic 120. The heat sink 108 may be in direct contact with the light source assembly (and, in particular, with the light source 128) and may extend the light source assembly 106 at least partially into the recess of the optic 120. In particular embodiments, the heat sink 108 holds the light source assembly 106 in a position in which the light source assembly 106 remains fully within the recess of the optic 120, throughout the full range of adjustable movement (e.g., pivot and/or rotation) of the optic 120 within the holding member 118, such that all light emitted from the light source assembly 106 passes through the optic 120 (with minimal loss). In other embodiments, the light source assembly 106 is held in a position in which the light source assembly 106 remains fully within the recess of the optic 120, throughout some, but not the full extent of motion of the optic 120 within the holding member 118. In an example embodiment, the heat sink 108 may also be partially extended into the recess of the optic 120, and may remain at least partially within the recess of the optic 120 throughout the full range of adjustable movement (e.g., pivot and/or rotation) of the optic 120.

In various embodiments, an end of the heat sink 108 may be exposed through the top member 112, for example, as shown in FIG. 3. Accordingly, when the light device assembly 100 is attached (or mounted) to a surface of an object 132 as shown in FIG. 1B, for example, the heat sink 108 may be arranged in heat-transfer communication with the object 132, to conduct heat away from the light source 128 to the object 132. In an example embodiment, the heat sink 108 may be arranged in direct contact with the surface of the object 132. In this case the object (e.g., a fixture housing) 132 may be made of any suitable material, composition, or layers thereof having suitable thermal conductance and/or heat dissipation characteristics, for example, such as copper, aluminum, steel, and/or the like. In some embodiments, the object 132 may include, for example, heat pipes, peltier coolers, fan/heat sink combo, water cooling systems, refrigerant systems, and/or the like.

The friction member 110 may provide a friction surface to maintain a pivoted position of the optic 120 and the holding member 118 within the housing member 102. For example, when the optic 120 is pivoted (with the holding member 118) to a desired position within the housing member 102, the friction surface of the friction member 110 frictionally engages the outer surface of the holding member 118, to prevent or substantially prevent the holding member 118 from shifting to a different position from the desired position due to gravity (i.e., without manual force). Preferably, the frictional force may be overcome by manual force applied to manually adjust or move (pivot and/or rotate) the optic 120 and the holding member 118 relative to the housing member 102. Accordingly, the friction member 110 or the engaging surface of the holding member 118 may include any suitable material to provide the friction surface, for example, but not limited to, silicone, rubber, and/or the like. In further examples, the friction surface of the friction member 110 or the engaging surface of the holding member 118 includes contour, roughness or other features that enhance friction. In an embodiment, the friction member 110 may have a shape of an upper hemisphere of a sphere, so that the engaging surface of the holding member 118 can slideably engage with the friction member 110. However, the present invention is not limited thereto, and in some embodiments, the friction member 110 may be omitted. In this case, an interior surface of the cavity of the housing member 102 and/or an exterior surface of the holding member 118 may include a friction surface as described above, to maintain a pivoted position of the optic 120.

The top member 112 may enclose the top of the housing member 102. For example, the top member 112 may include threading that mates with threading of the housing member 102, to be twist-locked on the housing member 102. However, the present invention is not limited thereto, and the top member 112 may enclose or connect to the top of the housing member 102 via any suitable method, such as, but not limited to, mating tabs and/or grooves, clips, screws, nails, adhesives, welding, combinations thereof, or the like.

As shown in FIG. 3, in various embodiments, the end of the heat sink 108 may be exposed through the top member 112. Accordingly, the heat sink 108 may be in close relation with (or contact) a surface of an object on which the lighting device assembly 100 is mounted, and may conduct heat from the light source 128 to the surface of the object. In a further example embodiment, an end of the friction member 110 may be interposed between the end of the heat sink 108 and the top member 112. In that embodiment, the end of the friction member 110 may also be exposed through the top member 112 between the heat sink 108 and a top surface of the top member 112.

Figure 4:
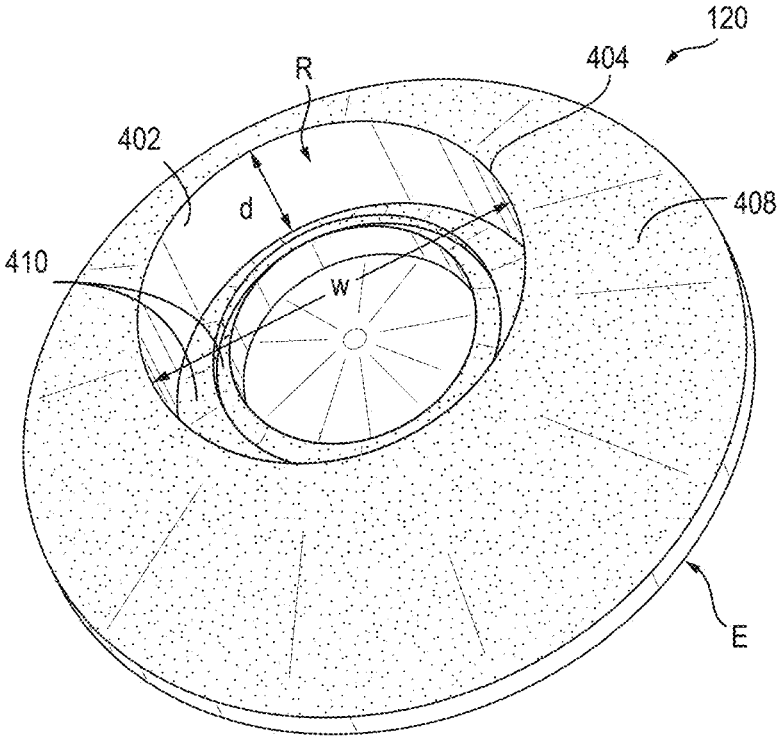
FIG. 4 is a perspective view of an optic of a lighting device assembly according to an example embodiment.

FIG. 4 is a perspective view of an optic of a lighting device assembly according to an example embodiment of the present invention. Referring to FIG. 4, the optic 120 includes a recess R. In various embodiments, the light source 128 and the heat sink 108 extend at least partially into the recess R of the optic 120. In various embodiments, the light source 128 (e.g., via the heat sink 108) remains at least partially in the recess R throughout the full range of motion (e.g., pivot and/or rotation) of the optic 120 (e.g., via the holding member 118). In various embodiments, the light source 128 remains stationary with respect to the housing member 102 and friction member 110, such that the optic 120 may freely move and pivot relative to and around the light source 128.

In various embodiments, optic 120 includes a side wall 402 having a top edge 404 that defines the recess R. A focal point of the optic 120 is located within a depth d of the recess R, such that the light source 128 remains at the focal point throughout the full range of motion (e.g., pivot and/or rotation) of the optic 120. In various embodiments, a width (or diameter) w of the recess R may limit a maximum degree amount (e.g., 10°, 30°, 45°, and the like) that the optic 120 may pivot about the light source 128. For example, the maximum degree amount that the optic 120 may pivot about the light source 128 may correspond to the width w of the recess R and a width (or diameter) of the heat sink 108 within the recess R, such that the optic 120 may pivot about the light source 128 until the top edge 404 of the recess R contacts a side wall of the heat sink 108. Accordingly, in various embodiments, the width w of the recess R may be wider than the width of the heat sink 108 such that at least a portion of the heat sink 108 may be received within the recess R, and may remain within the recess R to allow the optic 120 to pivot about the light source 128 by a desired degree amount.

In various embodiments, an upper surface 408 of the optic 120 may include a reflective surface (e.g., provided by a layer or coating of reflective material, contours, or combination thereof) to reflect light towards an emitting surface E of the optic 120. In various embodiments, the bottom surface of the recess R of the optic 120 may include one or more reflective elements 410 to reflect light towards the emitting surface E of the optic 120. In some embodiments, each of the reflective elements 410 may have an inner annular side surface that is perpendicular or substantially perpendicular to a focal axis of the optic 120, and an outer annular side surface that is angled relative to the focal axis of the optic 120. The angle of the outer annular side surface of each of the reflective elements 410 may slope downward (e.g., towards the emitting surface E) and outward (e.g., towards the sidewall 402). In some embodiments, the outer annular side surface may include a reflective surface (e.g., provided by a layer or coating of reflective material, contours, or combination thereof), to reflect light towards the emitting surface E of the optic 120. However, the present invention is not limited thereto, and the reflective elements 410 may be omitted or may have different shapes.

Figure 5:
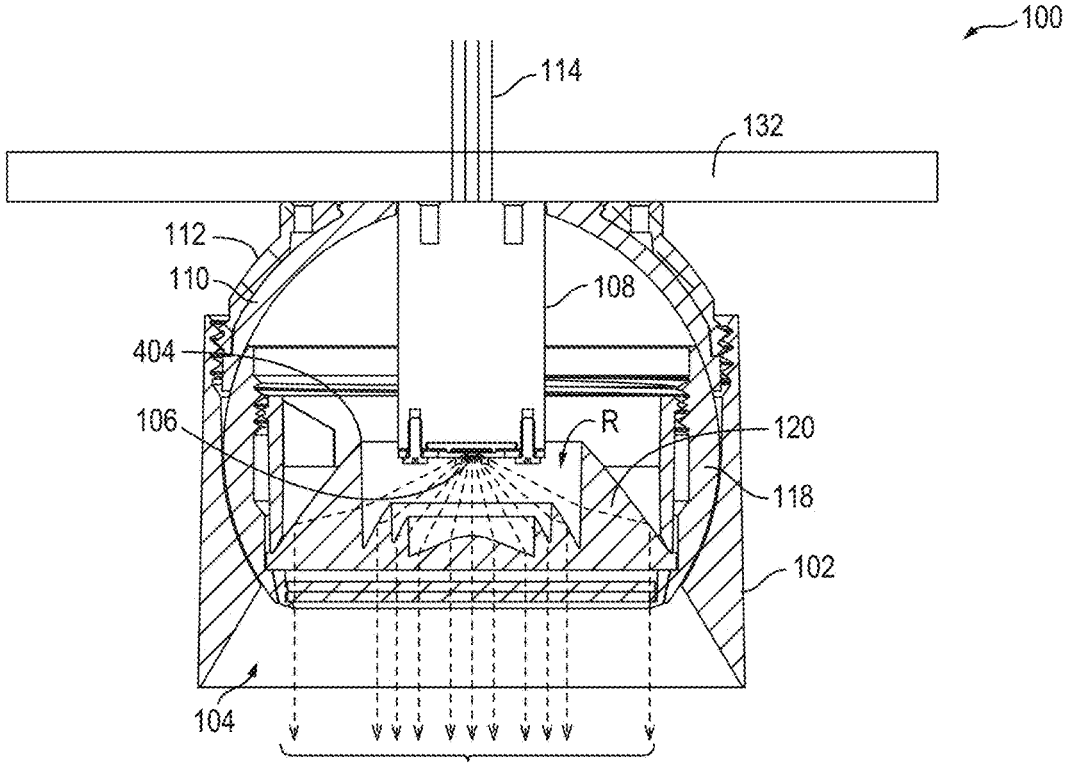
FIG. 5 is a cross-sectional view of a lighting device with the optic in a first position according to an example embodiment.
Figure 6:
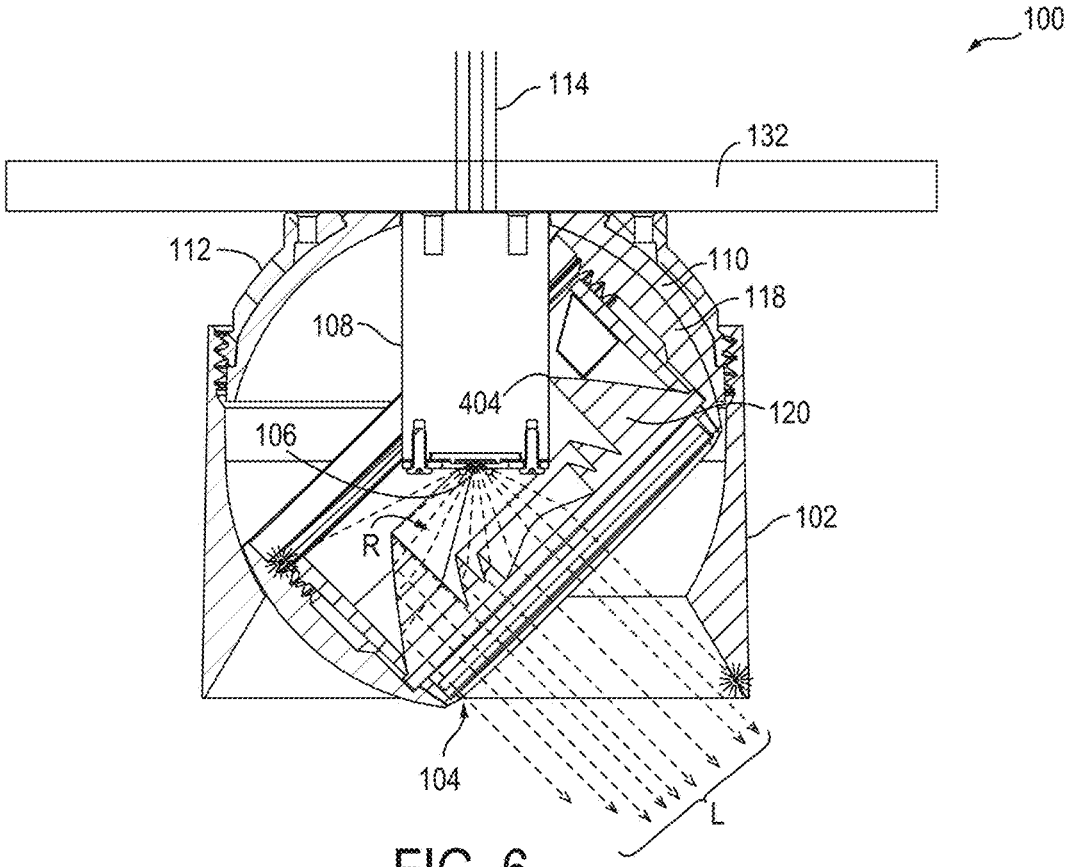
FIG. 6 is a cross-sectional view of the lighting device in FIG. 5 with the optic in a second position according to an example embodiment.

FIG. 5 is a cross-sectional view of a lighting device with the optic in a first position according to an embodiment of the present invention, and FIG. 6 is a cross-sectional view of the lighting device with the optic in a second position according to an embodiment of the present invention. Referring to FIGS. 4-6, the lighting device assembly 100 includes the housing member 102, the optic assembly 104 held in the cavity of the housing member 102, the light source assembly 106 attached (e.g., mounted) at an end of the heat sink 108, the friction member 110, and the top member 112. One end of the heat sink 108 is exposed through the top member 112, and may contact a surface of the object (e.g., a fixture housing) 132. Accordingly, the heat sink 108 may conduct heat away from the light source 128 directly to the object 132. The other end of the heat sink 108 on which the light source assembly 106 is attached (e.g., mounted) extends at least partially within the recess R of the optic 120. Accordingly, the light source assembly 106 extends at least partially within the recess R of the optic 120, and the optic 120 may freely move and pivot about the light source 128.

As shown in FIGS. 5 and 6, the light source 128 may be stationary with respect to the housing member 102 and the friction member 110, while the optic 120 may freely move and pivot about the light source 128. When the optic assembly 104 is pivoted from the first position to the second position, the exterior surface of the holding member 118 slideably engages with the cavity of the housing member 102 and the friction surface of the friction member 110. Accordingly, the friction member 110 maintains (or holds) the pivoted position of the holding member 118 against movement by gravity. According to an example embodiment, the housing member 102 may be loosened from the top member 112 (e.g., via twisting motion), and then tightened to the top member 112 (e.g., via twisting motion) after the optic assembly 104 is pivoted from the first position to the second position, so that a side of the holding member 118 is pressed into the friction member 110 and locked in the second position.

In various embodiments, the light source assembly 106 extends at least partially within the recess R of the optic 120 in each of the first position and the second position of the optic 120, and the light source 128 may be stationary with respect to the housing member 102 and the friction member 110, such that the optic 120 may freely move and pivot about the light source 128. The maximum amount or degree that the optic 120 can pivot about the light source assembly 106 may be limited by the width (or diameter) w of the recess R and the width (or diameter) of the side wall of the heat sink 108. For example, as shown in FIG. 6, the degree amount that the optic 120 may pivot may reach its maximum when the top edge 404 of the recess R contacts the sidewall of the heat sink 108. Accordingly, the width w (see FIG. 4) of recess R may be wider than the width of the heat sink 108 according to a desired maximum degree amount of pivot.

In various embodiments, the light source 128 of the light source assembly 106 may be stationary with respect to the housing member 102 and the friction member 110, and may remain at the focal point of the optic 120 within the depth d of the recess R throughout the full range of motion of the optic 120. Accordingly, as shown in FIG. 6, even when the optic 120 is pivoted, a portion of the light L that is emitted from the light source 128 may be beam-shifted to a portion of the optic 120 that is pivoted outward, such that substantially all of the light L emitted from the light source 128 is directed through the central region of the optic 120. In other lighting device assemblies where the light source 128 and the optic 120 are moved (or pivoted) together, the light L would normally be blocked by the housing member 102. However, according to various embodiments, the light L that would normally be blocked by the housing member 102 (e.g., if the light source 128 and optic 120 are moved together as in other lighting device assemblies) is beam-shifted to a portion of the optic 120 that has pivoted or rotated outward, to avoid (e.g., not be blocked by) the housing member 102 and minimize light loss.

Figure 7A:
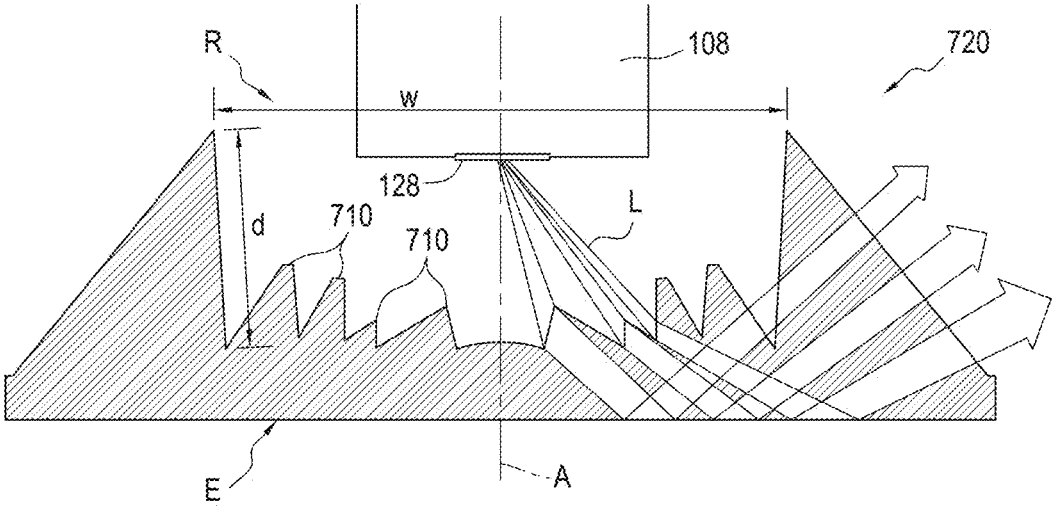
FIG. 7A is a cross-sectional view of an optic of a lighting device assembly according to an example embodiment.
Figure 7B:
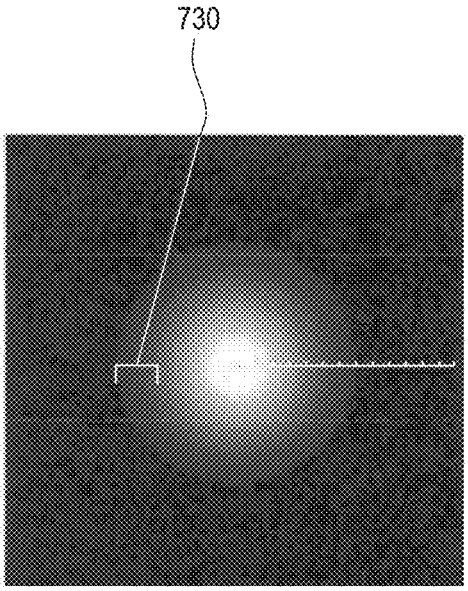
FIG. 7B illustrates a light field generated by the lighting device assembly having the optic shown in FIG. 7A according to an example embodiment.
Figure 7C:
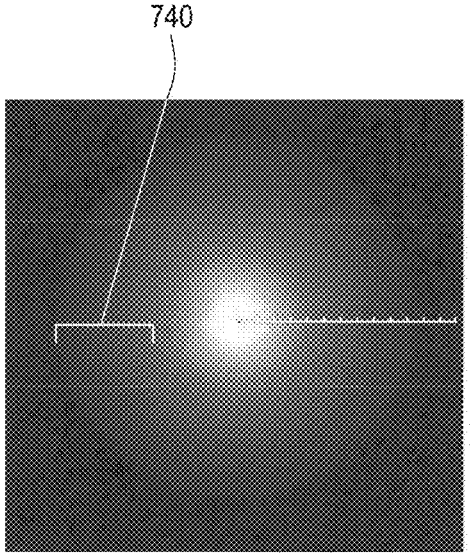
FIG. 7C illustrates a light field generated by a lighting device according to a comparative example.

FIG. 7A is a cross-sectional view of an optic of a lighting device assembly according to an example embodiment of the present invention. FIG. 7B illustrates a light field generated by the lighting device assembly having the optic shown in FIG. 7A. FIG. 7C illustrates a light field generated by a lighting device according to a comparative example. In some embodiments, the optic 720 shown in FIG. 7A may be employed as the optic 120 shown in FIG. 4. For example, in some embodiments, the optic 720 may have a recess R that receives the light source 128 and at least a portion of the heat sink 108 that extends partially into the recess R of the optic 720. A focal point of the optic 720 is located within a depth d of the recess R, such that the light source 128 remains at the focal point throughout the full range of motion (e.g., pivot and/or rotation) of the optic 720. A width w of the recess R may be wider than the width of the heat sink 108 such that at least a portion of the heat sink 108 may be received within the recess R, and may remain within the recess R to allow the optic 720 to pivot about the light source 128 by a desired degree amount. In other embodiments, the optic 720 and the heat sink 108 may be outside of the recess R during part or all of the full range of motion of the optic 720. In each of those embodiments, the heat sink 108 and the light source 128 may remain stationary with respect to the optic 720 throughout the full range of motion of the optic 720.

In some embodiments, the optic 720 may define (or shape) a light field of light emitted through an emitting surface E of the optic 710. For example, in some embodiments, the optic 720 may include one or more reflective elements 710 on an inner surface of the recess R, where the reflective elements 710 are configured to refract the portion of the incident light that is emitted by the light source 128 at an angle that is greater than or equal to a critical angle (or critical angle of incidence) with respect to a normal of (perpendicular line from) the emitting surface E of the optic 710. The refracted light (shown in large arrows in FIG. 7A) may be internally reflected off of the emitting surface E, into and absorbed by other portions (non-transparent portions) of the lighting device (e.g., a fixture). However, the portion of the incident light emitted by the light source at an angle that is less than the critical angle passes through the emitting surface E (as emitted light), such that light that is transmitted through the emitting surface E may have an outer light field (area of significantly reduced intensity) that is relatively small and/or more defined.

In some embodiments, the reflective elements 710 may have a size and/or shape depending, at least in part, on the refractive index of the material used to form the reflective elements 710 and the desired critical angle for internally reflecting light. For example, in some embodiments, the reflective elements 710 may include or be formed of a material having a refractive index of about 1.4 (or 1.4) to about 1.6 (or 1.6) to refract the incident light at a critical angle of about 39 degrees (or 39 degrees) or greater. In this case, each of the reflective elements 710 may have an inner annular side surface that is perpendicular or substantially perpendicular to a focal axis of the optic 720, and an outer annular side surface that is angled relative to the focal axis of the optic 720. The angle of the outer annular side surface of each of the reflective elements 710 may slope downward (e.g., towards the emitting surface E) and outward (e.g., towards a sidewall of the optic 720), with reference to the orientation shown in FIG. 7A. In other embodiments, materials having other suitable refractive indices or that define other suitable critical angles may be employed.

Thus, the optic 720 having the reflective elements 710 according to some embodiments may define (by size or shape, or both) a light field of light emitted through the emitting surface E of the optic 710, by internally reflecting a portion of the light L that is emitted by the light source 128 toward a periphery of the optic 720 to be absorbed by the lighting device. For example, in some embodiments, at least some portion of the light L emitted from the light source 128 is incident on the reflective elements 710, and is refracted by the reflective elements 710 at an angle greater than or equal to the critical angle (relative to the emitting surface E). The refracted light is internally reflected by the emitting surface E and absorbed by the lighting device. At least some portion of the light L incident on inner surfaces of the optic 720 is refracted at an angle that is less than the critical angle, so as to pass through the optic 710 and be emitted out from the emitting surface E. The light that is emitted through the emitting surface E may have a light field that is reduced and/or more defined (as compared to lighting devices that do not employ an optic configured as described herein).

For example, referring to FIGS. 7B and 7C, a representation of a light field 730 generated by a lighting device having the optic 720 is shown as being reduced and more defined when compared to the representation of a light field 740 that may be generated by a lighting device of a comparative device. As shown in FIG. 7B, a light beam generated by the lighting device having the optic 720 has 50% beam angle at 11 degrees, 10% light level field is at 22 degrees, and 1% light level field is at 40 degrees. In contrast, as shown in FIG. 7C, a light beam generated by a lighting device according to a comparative example has 50% beam angle at 11 degrees, 10% light level field is at 26 degrees, and 1% light level field is at 66 degrees.

In the example shown in FIG. 7A, the reflective elements 710 have a generally annular shape (shown in cross-section in the drawing of FIG. 7A) about an axis A. Each reflective element 710 in FIG. 7A has a first angled surface facing radially inward, and a second angled or arched surface facing radially outward, relative to the axis A. The location of the light source 128, the angle of the reflective element 710, and the refractive index of the optic 720 result in an angle of refraction of the of the light L through the optic 720 and, thus, result in an angle of the light L in the optic 720 relative to the emitting surface E. In particular embodiments, the reflective elements 710 are configured such that the angle of the light L in the optic 720 relative to the emitting surface E is such that a desired portion of the light L (the portion that would otherwise produce an unwanted field width) is reflected back by the emitting surface E, while a further desired portion of the light L is emitted through the emitting surface E to form the desired light beam. Therefore, the angle of the first surface (inner-facing surface) of the reflective elements 710 may be selected and provided, to provide a desired refraction angle for light emitted from the light source 128 to define the size or shape of the resulting beam of light emitted from the emitting surface (for a given optic refractive index and light source 128 position).

Figure 8A:
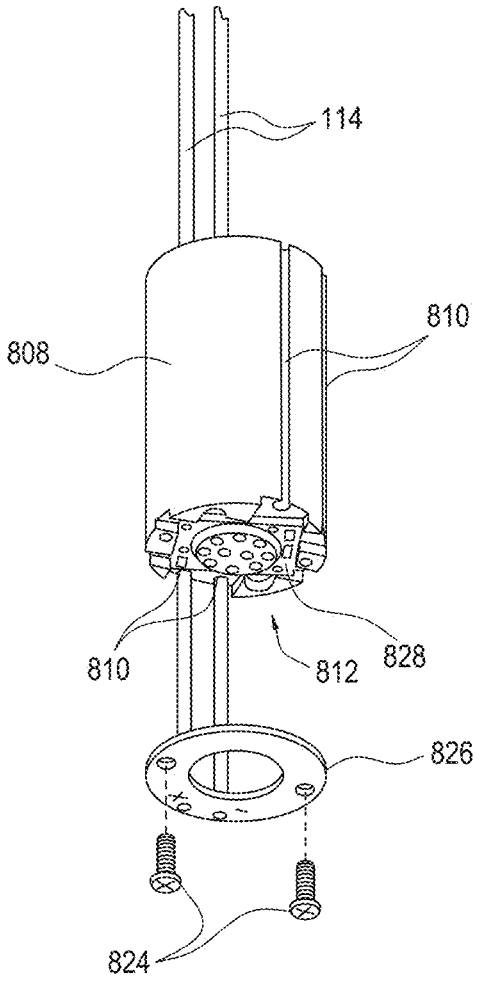
FIG. 8A is a perspective bottom view of a heat sink connected to a two terminal light source assembly according to an example embodiment.
Figure 8B:
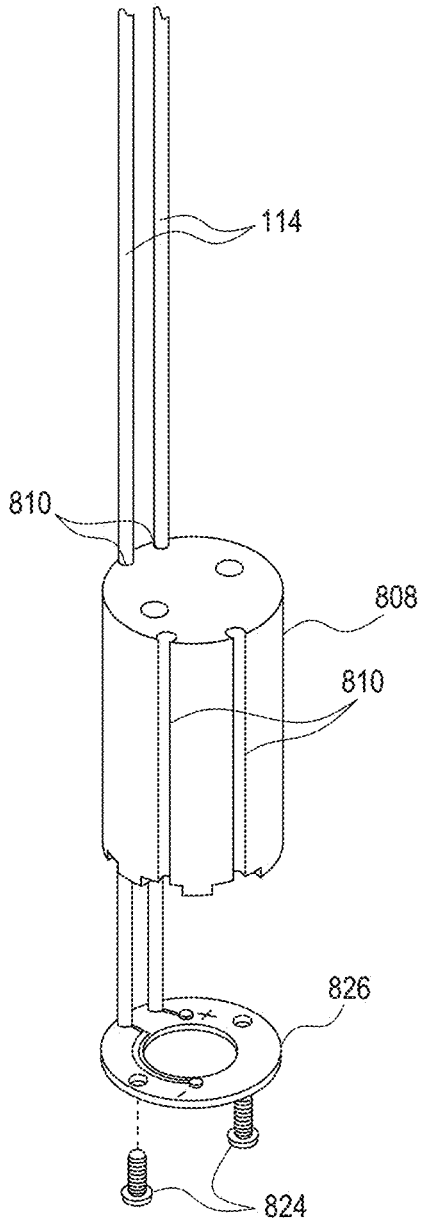
FIG. 8B is a perspective top view of the heat sink connected to the two terminal light source assembly shown in FIG. 8A.
Figure 8C:
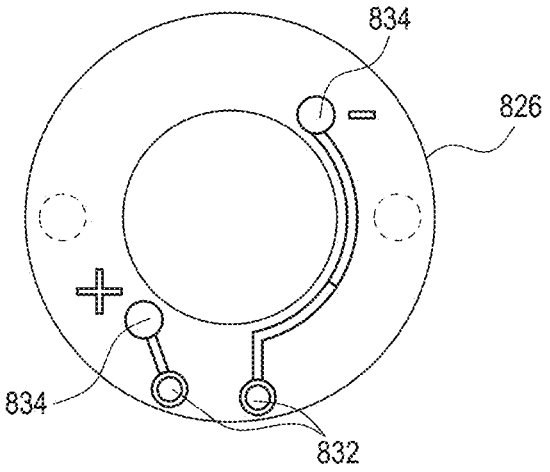
FIG. 8C is a top view of a frame member of the two terminal light source assembly according to an example embodiment.
Figure 8D:
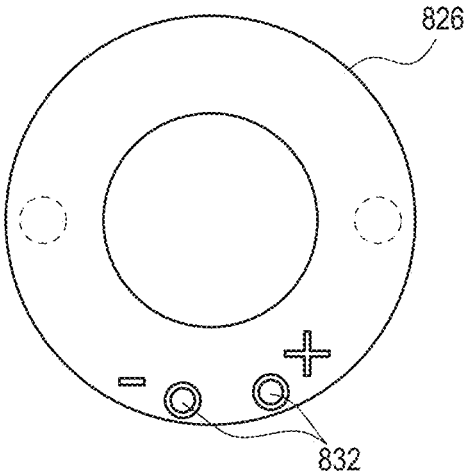
FIG. 8D is a bottom view of the frame member of FIG. 8C.
Figure 9A:
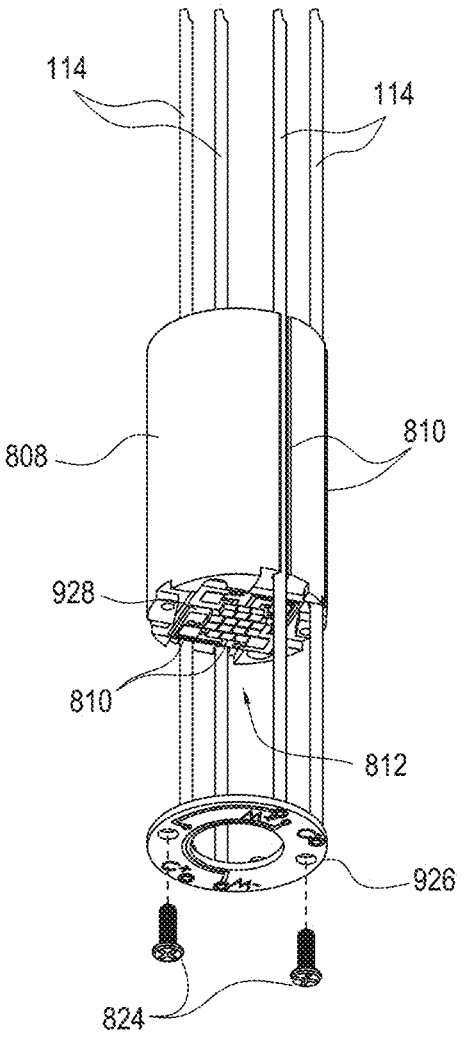
FIG. 9A is a perspective bottom view of a heat sink connected to a four terminal light source assembly according to an example embodiment.
Figure 9B:
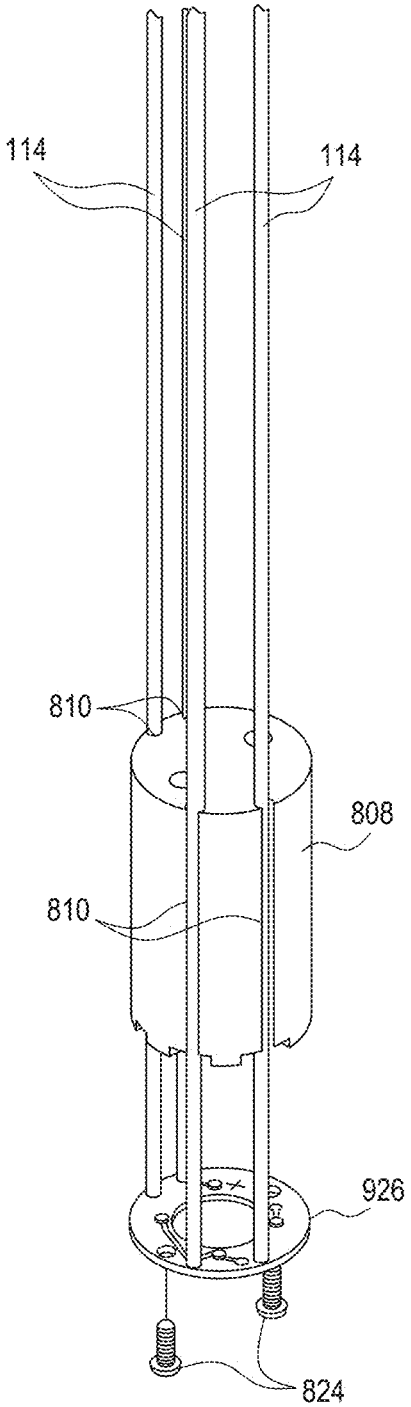
FIG. 9B is a perspective top view of the heat sink connected to the four terminal light source assembly shown FIG. 9A.
Figure 9C:
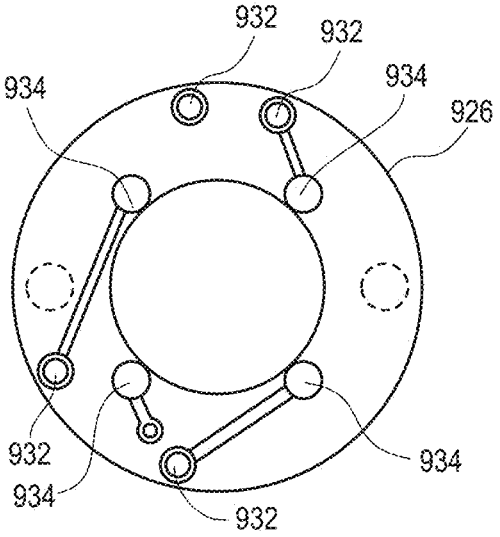
FIG. 9C is a top view of a frame member of the four terminal light source assembly according to an example embodiment of the present invention.
Figure 9D:
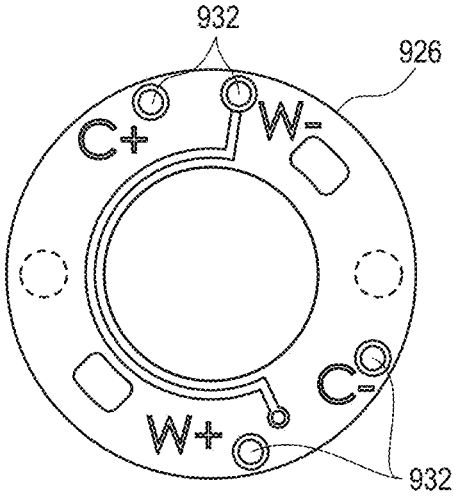
FIG. 9D is a bottom view of the frame member of FIG. 9C.

FIG. 8A is a perspective bottom view of a heat sink connected to a two terminal light source assembly according to an example embodiment. FIG. 8B is a perspective top view of the heat sink connected to the two terminal light source assembly shown in FIG. 8A. FIG. 8C is a top view of a frame member of the two terminal light source assembly according to an example embodiment, and FIG. 8D is a bottom view of the frame member of FIG. 8C. FIG. 9A is a perspective bottom view of a heat sink connected to a four terminal light source assembly according to an example embodiment. FIG. 9B is a perspective top view of the heat sink connected to the four terminal light source assembly shown FIG. 9A. FIG. 9C is a top view of a frame member of the four terminal light source assembly according to an example embodiment, and FIG. 9D is a bottom view of the frame member of FIG. 9C.

Referring generally to FIGS. 2, 3, 8A, 8B, 9A, and 9B, the heat sink 808 may be employed as the heat sink 108 shown in FIGS. 2 and 3. For example, the heat sink 808 may draw heat away from the light source (e.g., 825 in FIG. 8B and 925 in FIG. 9B) as described above with respect to heat sink 108. Accordingly, the heat sink 808 may be made of any suitable material, composition, or layers thereof having sufficient heat transfer and/or dissipation qualities, for example, aluminum, copper, and/or the like. In an example embodiment, the heat sink 808 may be formed (e.g., cast) from solid aluminum. The heat sink 808 may have a shape corresponding to an elongated body (e.g., a pedestal) that extends from the top of the lighting device assembly (e.g., top member 112 or fixture housing) to the recess R of the optic (e.g., 120 or 720). The heat sink 808 may be in direct contact with the light source assembly or light source (e.g., 128, 825, or 925) and may extend the light source assembly or light source (e.g., 128, 825, or 925) at least partially into the recess R of the optic (120 or 720). In some embodiments, the heat sink 808 holds the light source assembly or light source (e.g., 128, 825, or 925) in a position in which the light source assembly or light source remains fully within the recess R of the optic (120 or 720), throughout the full range of adjustable movement (e.g., pivot and/or rotation) of the optic within the holding member 118. In other embodiments, the heat sink 808 holds the light source assembly or light source (e.g., 128, 825, or 925) in a position in which the light source assembly or light source remains fully within the recess of the optic, throughout some, but not the full extent of motion of the optic within the holding member 118. In an example embodiment, the heat sink 808 may remain stationary while the optic (120 or 720) is moved relative to the heat sink 808 and light source, throughout the full range of motion of the optic. In an example embodiment, another end of the heat sink 808 may be in direct contact with a structure (e.g., fixture housing or external structure) suitable to dissipate heat away from the light source (128, 825, or 925) to the structure.

In some embodiments, the heat sink 808 may have a lengthwise dimension (the vertical dimension in FIGS. 9A and 9B) and include a plurality of channels 810 formed on a side surface of the heat sink 808 to provide passageways for receiving and holding the wires 114. In some embodiments, each of the plurality of channels 810 extends in the lengthwise direction and may have an opening along its entire lengthwise dimension, at the side surface of the heat sink 808. In some embodiments, each of the plurality of channels 810 may have a cross-sectional shape (cross-section taken perpendicular to the lengthwise dimension of the heat sink 808), where the cross-section shape of the channel is of a portion of a circle. Accordingly, each channel forms an arc-shape cutout at the opening, defining a "C" shaped clip through which a corresponding one of the wires 114 can be inserted from the side surface of the heat sink 808. In some embodiments, a width of the opening cutout may be smaller than a diameter of the circle and sufficiently smaller than the diameter of the wire 114, so that the wire 114 can be pushed through the opening cutout, and snapped into place within the channel. When snapped into the channel, the wire 114 may be held taut by the heat sink 808. Accordingly, in some embodiments, an assembly process of the lighting device assembly can be simplified, since the wires 114 can simply be snapped into the channels 810 and held in place by the heat sink 808 without additional adhesives, clips or connection structures.

In some embodiments, the heat sink 808 may be manufactured to include a first plurality of channels 810 (for example, but not limited to four or more channels 810) to accommodate any suitable number (e.g., 1-4) of wires needed to drive various different kinds of light sources. For example, the light source 825 shown in FIG. 8B may only require two wires 114, whereas the light source 925 shown in FIG. 9B may require four wires 114. In either case, the same heat sink 808 may be used to support either of the light sources 825 and 925, since the heat sink 808 includes at least four of the channels 810. Thus, a manufacturing process of the heat sink 808 may be simplified, since the same heat sink 808 can be manufactured to support multiple different kinds of light sources having multiple different wiring requirements.

Referring to FIGS. 8A, 8B, 8C, and 8D the heat sink 808 may be connected to a light source assembly (e.g., 106 in FIG. 2). The light source assembly may include a light source 828, a frame member 826, and an attachment element 824. In some embodiments, the light source 828, the frame member 826, and the attachment element 824 may be employed as the light source 128, the frame member 126, and the attachment element 124, respectively, as shown and described with reference to FIG. 2, and thus, may include the same or similar features as described above.

In some embodiments, the light source 828 may be received in a receiving groove 812 (described in more detail below with reference to FIG. 10) of the heat sink 808, and may be connected to the heat sink 808 via the attachment element 824 and the frame member 826. For example, in some embodiments, the frame member 826 may be made of an electrically non-conductive material that is arranged over the light source 828, and attached to the heat sink 808 via the attachment element 824 with the light source 828 interposed therebetween. The frame member 826 includes a central opening, through which the light source 828 may emit light, when the frame member 826 is arranged over the light source 828. In some embodiments, the frame member 826 may electrically connect the light source 828 to a power source via the wires 114, to provide power to the light source 828. In this case, the frame member 826 may include electrically conductive contacts 832 electrically connected to the wires 114, and electrically conductive contacts or terminal pads 834 electrically connected to the light source 828 and to the contacts 832. The frame member 826 may include one or more circuit boards having a substrate and traces that connect the wire contacts 832 to the terminal pads 834 to electrically connect the wires 114 to terminals of the light source 828.

As shown in FIG. 8A, in a non-limiting example embodiment, the light source 828 includes two terminals, and thus, requires two wires 114 to be connected to the two terminals. In this case, as shown in FIG. 8C, the frame member 826 includes two wire contacts 832 for connection to the two wires 114 and two terminal pads 834 for connection to the two terminals of the light source 828. The two terminal pads 834 may be arranged on the frame member 926 to be aligned with the two terminals of the light source 828, and the two wire contacts 832 may be arranged to be aligned with two of the channels 810, so that the wires 114 connected to the two wire contacts 832 can be snapped into corresponding ones of the channels 810 from the side of the heat sink 808. Thus, when the frame member 826 is attached to the heat sink 808 with the light source 828 interposed therebetween, the terminal pads 834 are in contact with the terminals of the light source 828 to electrically connect the light source 828 to the wires 114.

Referring to FIGS. 9A, 9B, 9C, and 9D the same or substantially the same components as those discussed with reference to FIGS. 8A and 8B are labeled with the same reference number. As shown in FIGS. 9A, 9B, 9C, and 9D a light source 928 may be received in the receiving groove 812 (described in more detail below with reference to FIG. 10) of the heat sink 808, and may be connected to the heat sink 808 via the attachment element 824 and a frame member 926. The light source 928 and the frame member 926 are similar to the light source 828 and the frame member 826, respectively, as shown in FIGS. 8A, 8C, and 8D, except that the light source 928 has four terminals driven by four wires 114 (instead of two terminals driven by two wires 114 of the light source 828 shown in FIG. 8A). Thus, in this case, the frame member 926 is configured to electrically connect the four terminals of the light source 928 to the four wires 114.

For example, as shown in FIG. 9C, the frame member 926 includes four wire contacts 932 for connection to the four wires 114 and four terminal pads 934 for connection to the four terminals of the light source 928. The four terminal pads 934 may be arranged on the frame member 926 to be aligned with the four terminals of the light source 928, and the four wire contacts 932 may be arranged to be aligned with four of the channels 810 so that the wires 114 connected to the four wire contacts 932 can be snapped into corresponding ones of the channels 810 from the side of the heat sink 808. Thus, when the frame member 926 is attached to the heat sink 808 with the light source 928 interposed therebetween, the terminal pads 934 contact the terminals of the light source 928 to electrically connect the light source 928 to the wires 114.

Accordingly, in some embodiments, the heat sink 808 may include any suitable number of channels 808 to support one or more kinds of light sources (e.g., 828 and 928) that require various different numbers of wires 114 to drive the one or more kinds of light sources. However, in other embodiments the number of channels 810 may correspond to the exact number of wires needed to drive a particular kind of light source. For example, the heat sink 808 shown in FIGS. 8A and 8B can include only two of the channels 810, because only two wires 114 are needed to drive the light source 828. On the other hand, while only four channels 810 are shown on the heat sink 808, other embodiments may include other suitable numbers of channels 810, depending on the number of wires required to drive various different kinds of light sources used with the heat sink 808. For example, in other embodiments, the number of channels may be more or less than four depending on the number of wires needed to drive one or more kinds of light sources.

In some embodiments, the light source (e.g., 828 and 928) are not soldered, glued, or otherwise adhered to the frame member (e.g., 826 and 926), so that the light source (e.g., 828 and 928) and/or the frame member (e.g., 826 and 926) can be readily replaced as needed or desired. For example, the light source (e.g., 828 and 928) may be held in the receiving groove 812, and the frame member (e.g., 826 and 926) may be pressed against the light source (e.g., 828 and 928) without being adhered thereto, such that the terminal pads (e.g., 834 and 934) of the frame member (e.g., 826 and 926) contact the terminals of the light source (e.g., 828 and 928). In some embodiments, the frame member (e.g., 826 and 926) may include a core material having a sufficient flexibility and resilience to return to its original shape when flexed, for example, such as but not limited to a composite material (e.g., FR4). However, a composite material such as FR4 may lose tension retaining properties (e.g., tension memory) as the frame member (e.g., 826 and 926) is subjected to thermal cycling. Thus, in other embodiments, where tension retaining properties are important or desired, the core material may include a metal (e.g., aluminum, steel, or the like). For example, in some embodiments, the frame member (e.g., 826 and 926) may be a double-sided aluminum core circuit board having a substrate and traces on each side of the aluminum core. However, in other embodiments, the frame member (e.g., 826 and 926) may include another suitable core material, such as but not limited to a combination of metals or a combination of other materials (e.g., a composite material) with one or more metals.

Figure 10:
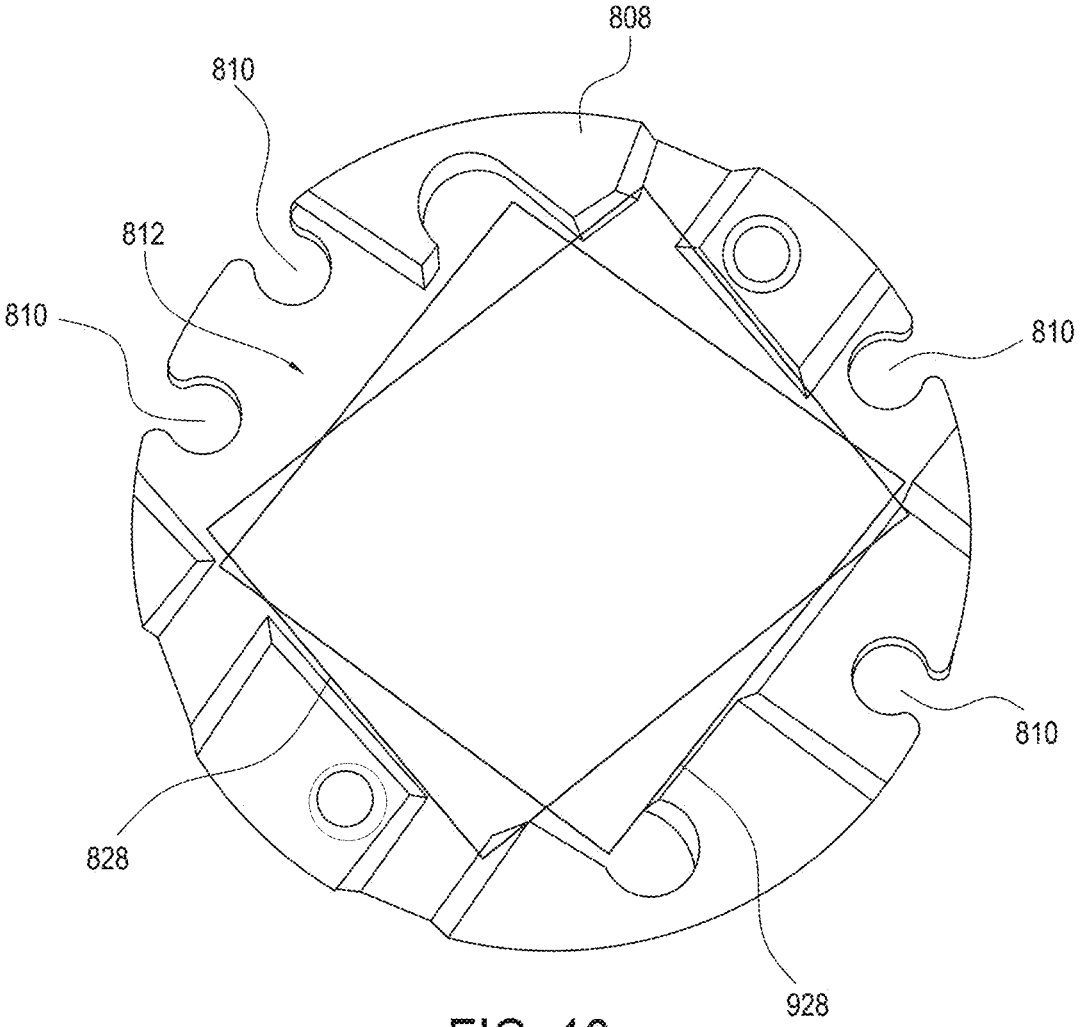
FIG. 10 is a bottom view of the heat sink shown in FIGS. 8A and 9A, according to an example embodiment.

FIG. 10 is a bottom view of the heat sink 808 shown in FIGS. 8A and 9A, according to an example embodiment. Referring to FIGS. 8A, 9A, and 10, in some embodiments, the heat sink 808 may include the receiving groove 812 on an end surface (e.g., bottom surface) facing the frame member (e.g., 826 and 926). The receiving groove 812 is configured to receive the light source (e.g., 828 and 928). In some embodiments, the receiving groove 812 may have a shape to prevent or substantially prevent the light source (e.g., 828 and 928) from shifting or moving when received in the receiving groove 812. For example, in some embodiments, the light source (e.g., 828 and 928) may directly contact the heat sink 808 so that the heat sink 808 can dissipate heat away from the light source (e.g., 828 and 928) as described above, without the light source (e.g., 828 and 928) being soldered, glued, or otherwise adhered to the heat sink 808, so that the light source (e.g., 828 and 928) can be replaced as needed or desired. In this case, the receiving groove 812 retains the light source (e.g., 828 and 928) in place in a desired position on the heat sink 808, so that the terminals of the light source (e.g., 828 and 928) can remain in contact with the terminal pads (e.g., 834 and 934) of the frame member (e.g., 826 and 926) when the light source (e.g., 828 and 928) is held between the heat sink 808 and the frame member (e.g., 826 and 926) as described above.

In some embodiments, the receiving groove 812 may be configured to receive and support different shapes and/or dimensions of various different kinds of light sources (e.g., 828 and 928). For example, as shown in FIG. 10, the light source 828 has an elongated rectangular shape, while the light source 928 has a square shape. However, the receiving groove 812 has a shape that can receive various different light sources of different shapes and/or dimensions (e.g., light sources 828 and 928), while preventing or substantially preventing the different kinds of light sources (e.g., 828 and 928) from shifting or moving when received in the receiving groove 812 as discussed above. For example, as shown in FIG. 10, the receiving groove 812 may define a recess having a shape with various side edges and canals to receive and support the different shapes of the lights sources 828 and 928 (or other light sources), while preventing or substantially preventing each from shifting or moving once received in the receiving groove 812. In other examples, instead of or in addition to a recess, the receiving groove 812 may be formed by an area space located between one or more ridges, protrusions, or other features that extend outwardly from the end of the heat sink 808. In particular embodiments, a manufacturing process of making the heat sinks 808 for multiple lighting devices may be simplified, because the same heat sink 808 configuration may be manufactured to support multiple different kinds of light sources having various different shapes and/or dimensions. For example, in various embodiments, the receiving groove 812 may be sized and shaped to receive and support a CXB-1310 LED, CLU701 LED, COBI-1512 LED, a color tune XD-16 LED, and/or the like.

However, in other embodiments, the receiving groove 812 may have a shape corresponding to (for accommodating) a shape of a particular kind of light source. Further, in other embodiments, the light source (e.g., 828 and 928) may be soldered, glued, or otherwise adhered to the end of the heat sink 808. In this case, the receiving groove 812 may have a generally large shape that can accommodate various different shapes and/or dimensions without having walls, protrusions or other features arranged to prevent light sources of the different shapes and/or dimensions from shifting or moving when received in the receiving groove 812. In yet other embodiments, the receiving groove 812 may be omitted, and the light source (e.g., 828 and 928) may be soldered, glued, or otherwise attached to the end of the heat sink 808 or to the frame member (e.g., 826 and 926).

Figure 11A:
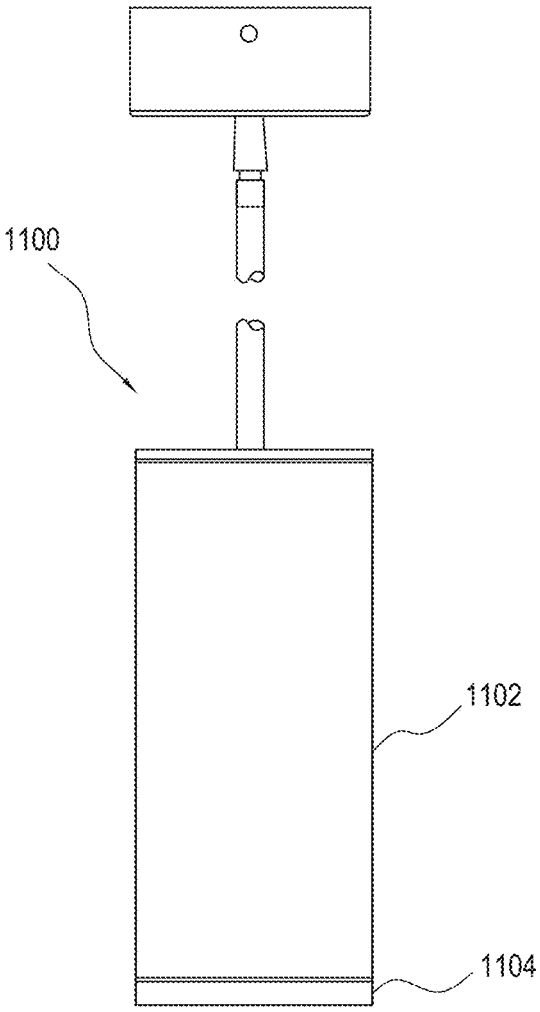
FIG. 11A is a side view of a canister lighting device according to an example embodiment.
Figure 11B:
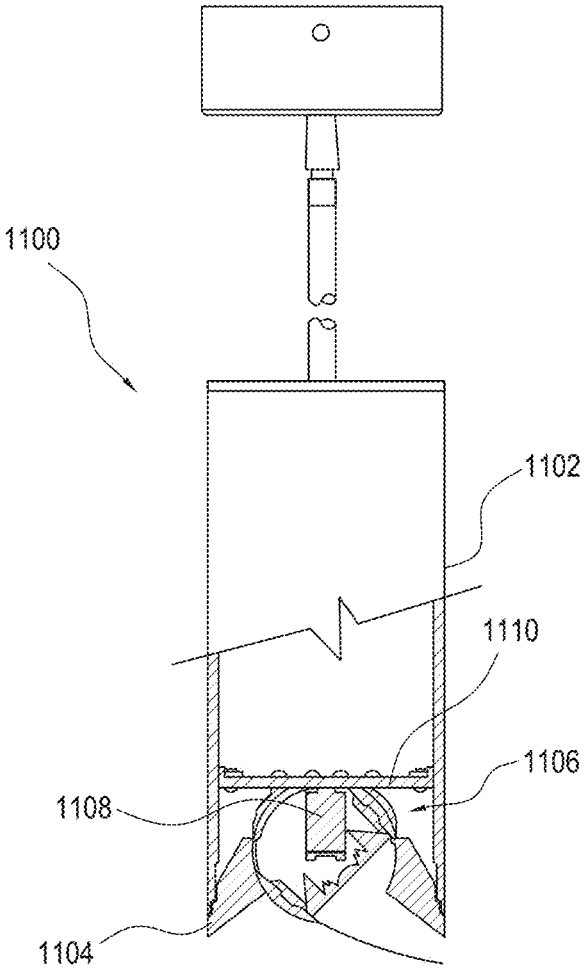
FIG. 11B is a partial cut-away view of the canister lighting device shown in FIG. 11A.

FIG. 11A is a side view of a canister lighting device according to an example embodiment. FIG. 11B is a partial cut-away view of the canister lighting device shown in FIG. 11A. The canister lighting device 1100 shown in FIGS. 11A and 11B may be employed as the lighting device shown in FIGS. 2 and 3, except that the housing member 102 of the lighting device shown in FIGS. 2 and 3 may be omitted and replaced with a canister housing member 1102 and a cap member 1104. For example, referring to FIGS. 2, 11A, and 11B, the canister lighting device 1100 may include a lighting device assembly 1106 including the optic assembly 104, the light source assembly 106 mounted to a heat sink 1108, the friction member 110, and the top member 112. The heat sink 1108 may be the same as or similar to the heat sink 108 or the heat sink 808 as described and shown with respect to FIGS. 2, 8A, 8B, 9A, 9B, and 10. The light source assembly 106 may include the attachment element (e.g., 124 or 824), the frame member (e.g., 126, 826, or 926), and the light source (e.g., 128, 828, or 928) interposed between the heatsink 1108 and the frame member (e.g., 126, 826, or 926), as described herein. The optic assembly 104 may include the holding member 118, the optic (e.g., 120 or 720), the locking member 122, and optionally, the lens filter 116, as described and shown with respect to FIG. 2. The optic assembly 104 may pivot and/or rotate within the canister housing member 1102 and the cap member 1104 to adjust a direction of emitted light, as described herein. While FIGS. 11A and 11B show that the canister housing member 1102 has a generally cylindrical shape, other embodiments may include housing members 1102 having other suitable shapes, including but not limited to curved or partially spherical shapes, conical, cube or cuboid shapes, rectangular shapes, triangular shapes, or the like.

In some embodiments, the canister housing member 1102 may have a cavity for housing the lighting device assembly 1106, and the cap member 1104 may mate with or otherwise connect to the canister housing member 1102 to hold the lighting device assembly 1106 therein. In some embodiments, the cap member 1104 may have a curved inner surface shaped to correspond to a portion of a sphere, and defining a cavity to receive at least a portion of the holding member 118. In some embodiments, the curved outer surface of the holding member 118 slideably engages the curved inner surface of the cap member 1104 in a ball and socket manner, to allow the optic (e.g., 120 or 720) to be pivoted or rotated about the light source (e.g., 128, 828, or 928). In some embodiments, the cap member 1104 may be loosened from the canister housing member 1102 (e.g., via a twisting motion on one direction, such as counterclockwise), and then tightened to the canister housing member 1102 (e.g., via twisting motion in another direction, such as clockwise) after the optic assembly 104 is pivoted from a first position to a second position, so that a side of the holding member 118 is pressed into the friction member 110 and locked in the second position. In some embodiments, the canister housing member 1102 may include threads that mate with threads on the cap member 1104 to twist and thread (or twist-lock) the cap member 1104 to the canister housing member 1102. However, in other embodiments, the cap member 1104 may be connected to the canister housing member 1102 via any suitable method, such as, but not limited to, mating tabs and/or grooves, clips, screws, nails, adhesives, welding, combinations thereof, or the like.

In some embodiments, the canister housing member 1102 may include a fixture plate 1110. The heat sink 1108 may be mounted on or otherwise attached to the fixture plate 1110, and may directly contact the fixture plate 1110. In some embodiments, the heat sink 1108 may conduct heat away from the light source (e.g., 128, 828, or 928) to the fixture plate 1110, and the fixture plate 1110 may transfer the heat to the canister housing member 1102 where it can be dissipated into the environment. In this case, the fixture plate 1110 and the canister housing member 1102 may be made of any suitable material, composition, or layers thereof having sufficient heat transfer and/or dissipation qualities, for example, aluminum, copper, and/or the like. In some embodiments, the fixture plate 1110 may include, for example, heat pipes, peltier coolers, fan/heatsink combo, water cooling systems, refrigerant systems, and/or the like, for improved cooling or improved heat transfer characteristics.

Figure 12A:
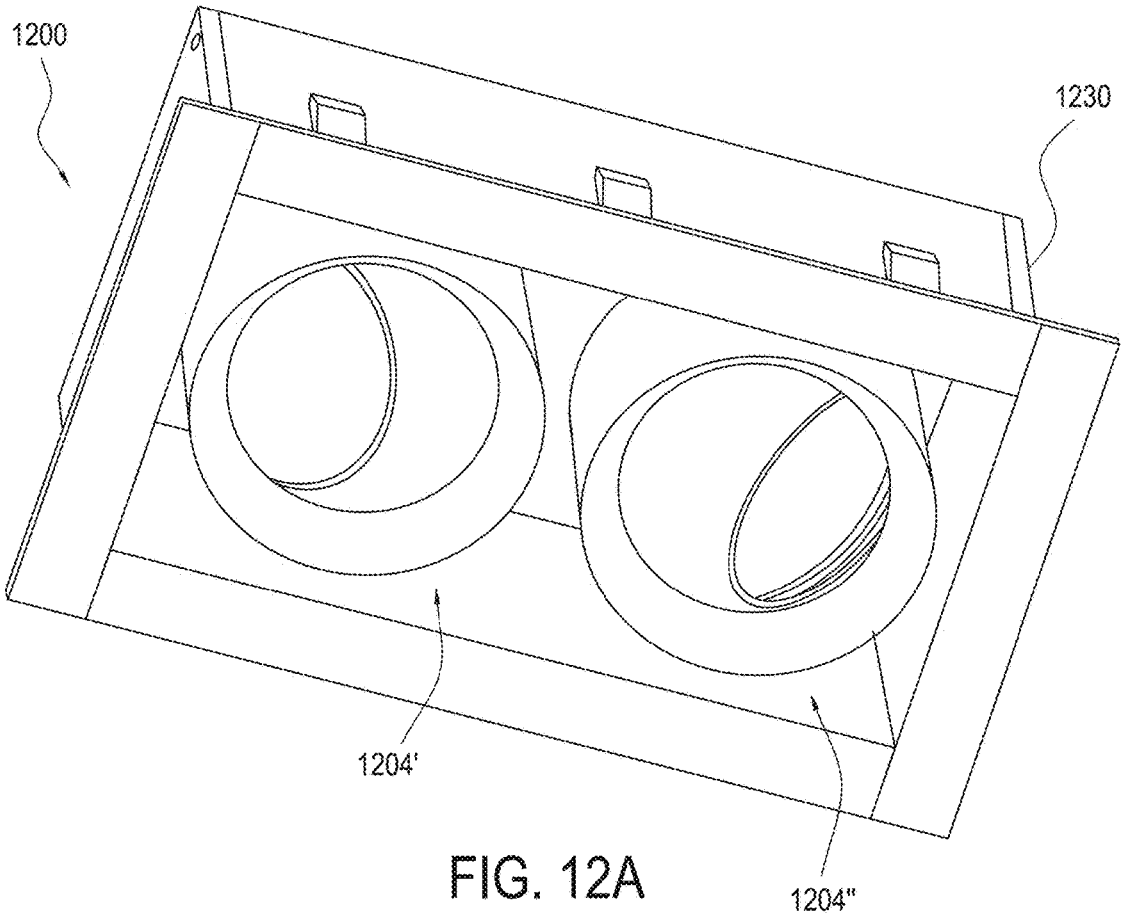
FIG. 12A is a multi-light lighting device assembly according to an example embodiment.
Figure 12B:
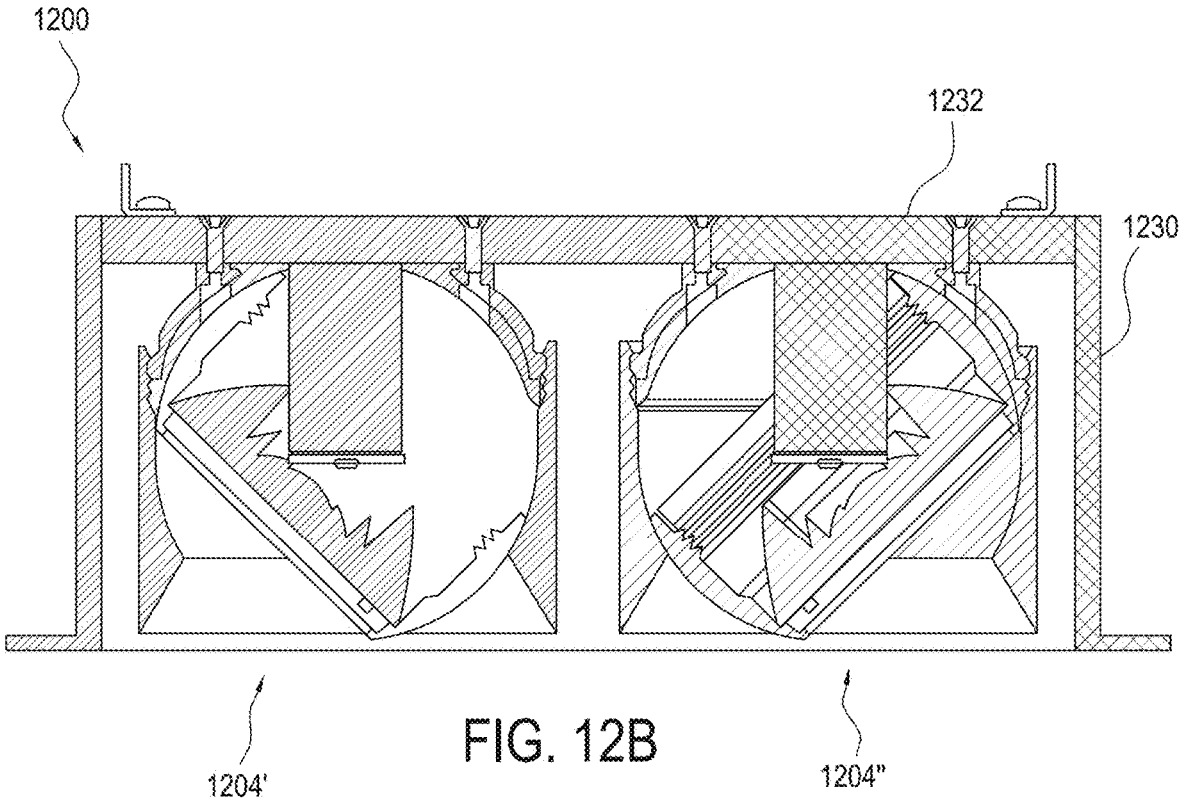
FIG. 12B is a cross-sectional view of the multi-light lighting device assembly shown in FIG. 12A.

FIG. 12A is a multi-light lighting device assembly according to an example embodiment of the present invention, and FIG. 12B is a cross-sectional view of the multi-light lighting device assembly shown in FIG. 12A. Referring to FIGS. 12A and 12B, the multi-light lighting device assembly 1200 may include a fixture frame 1230 having a plurality of lighting devices including a first lighting device 1204' and a second lighting device 1204" adjacent to the first lighting device 1204'. In certain embodiments, the first lighting device 1204' is similar or identical to the second lighting device 1204". In other examples, the first and second lighting devices 1204' and 1204" may be different from each other. In particular examples, each of the first and second lighting devices 1204' and 1204" may be the same or substantially the same as the lighting device shown in FIG. 2 or other drawings herein.

Figure 12C:
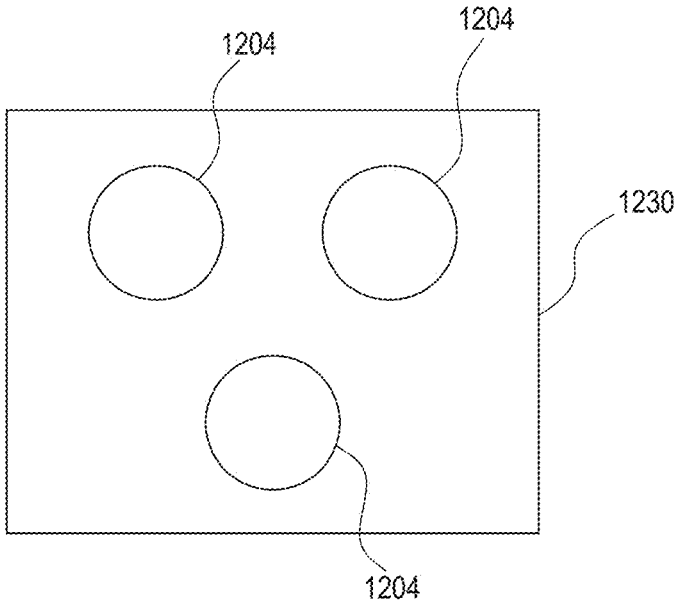
FIGS. 12C, 12D, and 12E are various multi-light lighting device assemblies according to various example embodiments.
Figure 12D:
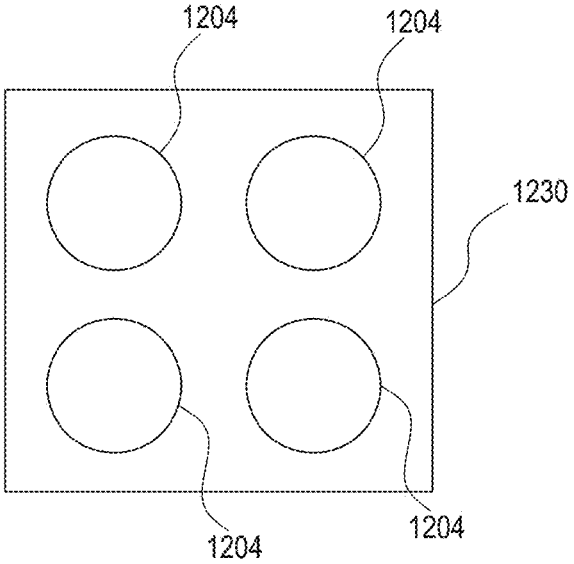
Figure 12E:
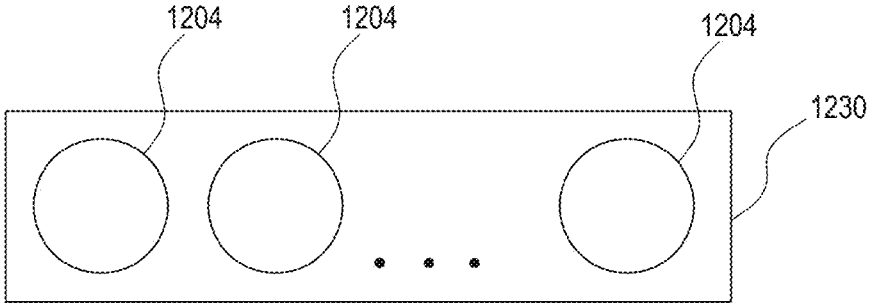

As shown in FIG. 12A, each of the first and second lighting devices 1204' and 1204" can have optic assemblies that are pivoted 45 degrees (or greater) in opposite directions and away from each other. In contrast, in other lighting devices where the heat sink is moved with the optic assembly in order to adjust a direction of light, the heat sinks can interfere with each other if the lighting devices are arranged too close to each other. This is especially the case when the optic assemblies are pivoted in opposite directions to face away from each other as shown in FIG. 12A. However, according to various embodiments described herein, since the heat sinks remain stationary with respect to the optics, the lighting devices 1204' and 1204" may be arranged relatively close to each other while allowing the full range of motion of the optic assemblies. Further, in some embodiments, the heat sinks remain stationary with respect to a surface of an object 1232 (e.g., a fixture plate), and thus, the heat sinks of the lighting devices 1204' and 1204" may be directly attached to the same surface of the object 1232. While the example in FIGS. 12A and 12B has a fixture frame 1230 containing two lighting devices 1204' and 1204", other embodiments may include a fixture frame containing more than two lighting devices. For example, a fixture frame 1230 represented in FIGS. 12C-12E may be configured to hold three, four, or more lighting devices 1204 (e.g., 1204' or 1204"). While the fixture frame 1230 has a generally rectangular cube shape, in other embodiments, a fixture frame may have other suitable shapes (including but not limited to other polygonal cuboid shapes, curved or rounded housing shapes, cylindrical shapes, toroidal shapes, or the like.

Figure 13A:
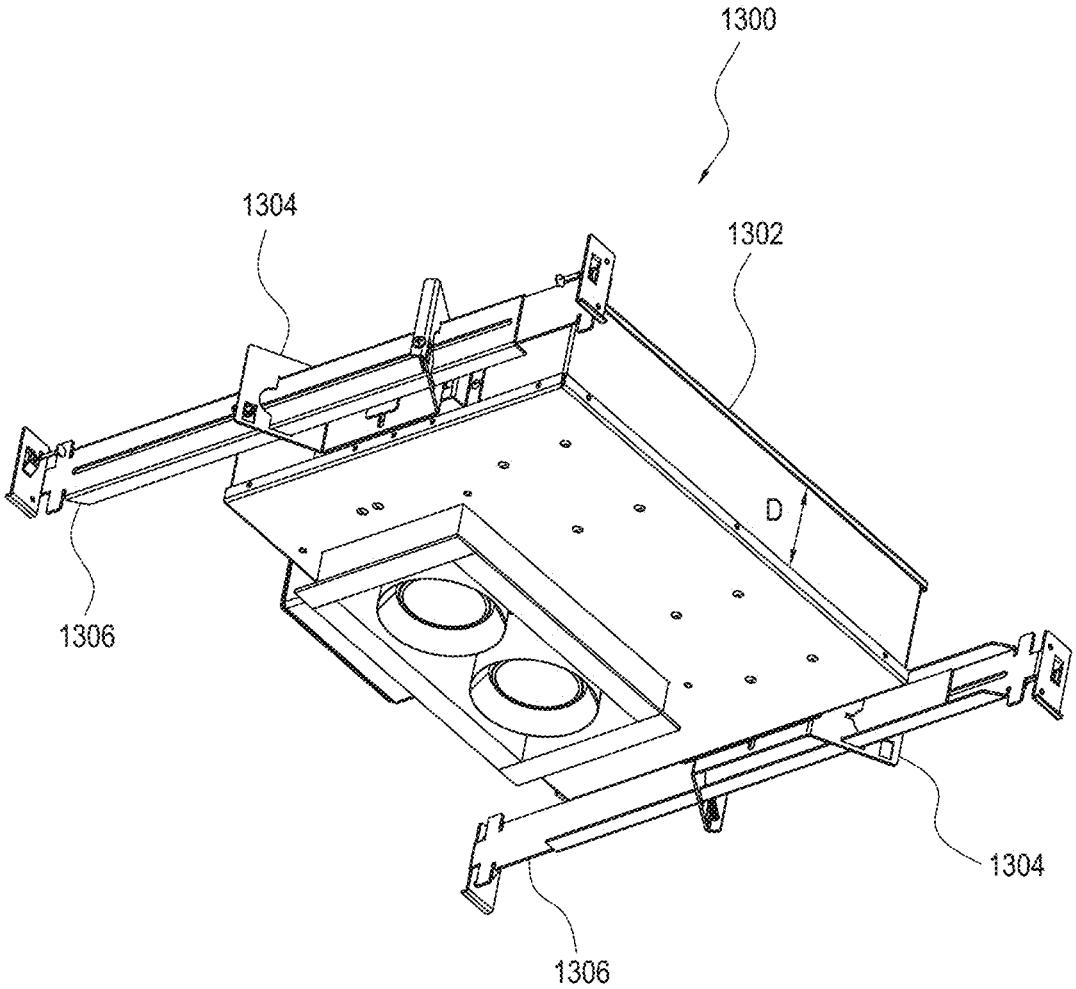
FIG. 13A is a top perspective view of a housing assembly for a lighting device according to an example embodiment.
Figure 13B:
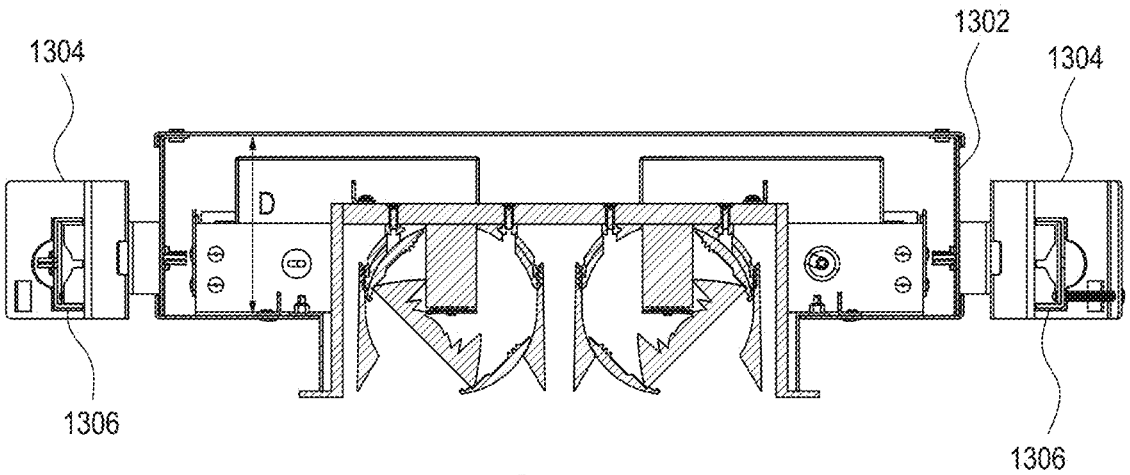
FIG. 13B is a front side view of the housing shown in FIG. 13B.

FIG. 13A is a top perspective view of a housing for a lighting device according to an example embodiment of the present invention, and FIG. 13B is a front side view of the housing shown in FIG. 13B. Referring to FIGS. 13A and 13B, the housing 1300 includes an isolation body 1302 to house one or more lighting devices (e.g., 100) of the embodiments of the present invention. The isolation body 1302 is connected to a plurality of adjustable brackets 1304 for mounting on a plurality of male and female slippers 1306. The male and female slippers 1306 may be expanded or collapsed to mount the isolation body 1302 within various spaces. As shown in FIG. 13B, since the heat sinks of the lighting devices remain stationary, a depth D of the isolation body 1302 may be smaller than those of comparative housings where the heat sink is moved to adjust a direction of light. Accordingly, the housing 1306 may have a lower profile than those of comparative housings.

As discussed above, in various embodiments, heat may be transferred from the light source directly to a surface of an object (e.g., fixture housing) via the heat sink, and thus, heat transferred from the light source may be improved, and brightness of the light source may be improved. Further, in various embodiments, the optic may move (e.g., pivot and/or rotate) freely about a stationary light source, while keeping at least a portion of the light source within a recess of the optic throughout the full range of motion of the optic, to minimize light loss.

The foregoing description of illustrative embodiments has been presented for purposes of illustration and of description. It is not intended to be exhaustive or limiting, and modifications and variations may be possible in light of the above teachings or may be acquired from practice of the disclosed embodiments. Various modifications and changes that come within the meaning and range of equivalency of the claims are intended to be within the scope of the invention. Thus, while certain embodiments of the present invention have been illustrated and described, it is understood by those of ordinary skill in the art that certain modifications and changes can be made to the described embodiments without departing from the spirit and scope of the present invention as defined by the following claims, and equivalents thereof.

What is claimed is:

1. A lighting device comprising:

a light source;

an optic device configured to pass at least some light from the light source, the optic device comprising:

a recessed bottom surface facing the light source;

an emitting surface opposite the recessed bottom surface; and a plurality of radially spaced light directing elements arranged on the recessed bottom surface, each light directing element configured to refract light received from the light source at a critical angle relative to the emitting surface;

wherein the emitting surface is configured to internally reflect the light refracted by the plurality of light directing elements; and wherein the lighting device is configured to absorb the light that is internally reflected by the emitting surface;

an optic assembly including a holding member configured to pivot about the light source, the holding member having an interior volume in which the optic device is contained; and a housing member having a first curved surface defining a cavity in which at least a portion of the holding member is received, wherein the holding member has an outer surface having a curvature that is configured to slideably engage with the first curved surface of the housing member when the optic assembly is pivoted about the light source.

2. The device of claim 1, wherein the critical angle is 39 degrees or greater with respect to a normal of the emitting surface.

3. The device of claim 2, wherein the one or more reflective elements include a material having a refractive index of 1.4 to 1.6.

4. The device of claim 1, wherein each light directing element has an inner annular side surface that is substantially perpendicular to a focal axis of the optic device, and an outer annular side surface that is angled relative to the focal axis of the optic device and sloped downward towards the emitting surface and outward towards a periphery of the optic device.

5. The device of claim 1, further comprising a heat sink having a first end connected to the light source and facing the recessed bottom surface, a second end opposite the first end, and a side surface between the first end and the second end.

6. The device of claim 5, wherein a plurality of channels are formed on the side surface, each of the plurality of channels having an opening along its entire length at the side surface.

7. The device of claim 6, wherein each of the plurality of channels has a cross-sectional shape of a portion of a circle with an arc cutout for the opening, a width of the arc cutout being smaller than a diameter of the circle.

8. The device of claim 6, further comprising a frame member including a body having a central opening attached to the first end of the heat sink with the light source interposed between the first end and the frame member and arranged to emit light through the central opening of the body of the frame member, the frame member configured to electrically connect the light source to a plurality of wires received in at least some of the plurality of channels.

9. The device of claim 8, wherein the frame member comprises:

wire contacts connected to the plurality of wires; and terminal pads configured to align with and contact terminals of the light source when the frame member is attached to the first end of the heat sink with the light source interposed between the first end and the frame member.

10. The device of claim 5, wherein the first end of the heat sink includes a receiving groove that defines a recess having a shape configured to receive the light source.

11. The device of claim 10, wherein the recess of the receiving groove having a shape configured to receive at least two different predefined light source shapes for at least two different types of light sources.

12. The device of claim 5, further comprising a frame member including a body having a central opening attached to the first end of the heat sink with the light source interposed between the first end and the frame member and arranged to emit light through the central opening of the body of the frame member, the frame member configured to retain the light source on the first end of the heat sink.

13. The device of claim 1, further comprising a heat sink having a first end connected to the light source and facing the recessed bottom surface, the heat sink extending at least partially into the cavity of the housing member.

14. The device of claim 1, wherein the light source is located in the interior volume of the holding member.

15. The device of claim 1, further comprising a heat sink having a first end, wherein the light source is mounted on the first end of the heat sink and wherein the first end of the heat sink is located in the interior volume of the holding member.

16. A lighting device comprising:

a heat sink having a first end, a second end opposite the first end, and a side surface between the first end and the second end;

a light source contacting the first end of the heat sink;

a frame member attached to the first end of the heat sink with the light source interposed between the first end and the frame member, the frame member configured to electrically connect the light source to a plurality of wires;

an optic device configured to pass at least some light from the light source;

an optic assembly including a holding member configured to pivot about the light source, the holding member having an interior volume in which the optic device is contained; and a housing member having a first curved surface defining a cavity in which at least a portion of the holding member is received, wherein the holding member has an outer surface having a curvature that is configured to slideably engage with the first curved surface of the housing member when the optic assembly is pivoted about the light source; and wherein, the first end of the heat sink is located in the interior volume of the holding member.

17. The device of claim 16, wherein a plurality of channels are formed on the side surface of the heat sink, each of the plurality of channels having an opening along its entire length at the side surface.

18. The device of claim 17, wherein each of the plurality of channels has a cross-sectional shape of a portion of a circle with an arc cutout for the opening, a width of the arc cutout being smaller than a diameter of the circle.

19. The device of claim 17, wherein each of the plurality of wires are configured to be inserted in a corresponding one of the plurality of channels from the side surface of the heat sink via the opening.

20. The device of claim 19, wherein some of the plurality of channels do not receive any of the plurality of wires.

21. The device of claim 16, wherein the frame member comprises:

wire contacts connected to the plurality of wires; and terminal pads aligned with terminals of the light source when the frame member is attached to the first end of the heat sink with the light source interposed between the first end and the frame member.

22. The device of claim 21, wherein the light source is not attached to the frame member, and the frame member presses against the light source so that the terminal pads of the frame member contact the terminals of the light source when the frame member is attached to the first end of the heat sink.

23. The device of claim 22, wherein the frame member is a double-sided aluminum core circuit board.

24. The device of claim 16, wherein the first end of the heat sink includes a receiving groove configured to hold the light source.

25. The device of claim 24, wherein the receiving groove has a shape configured to receive various different kinds of light sources having different shapes and/or dimensions.

* * * * *